US012060176B2

(12) United States Patent
Chang et al.

(10) Patent No.: US 12,060,176 B2
(45) **Date of Patent: *Aug. 13, 2024**

(54) SYSTEMS AND PROCESSES FOR PACKING ARTICLES OF FOOTWEAR

(71) Applicant: Nike, Inc., Beaverton, OR (US)

(72) Inventors: Pu-Yuan Chang, Taichung (TW); Chin-Ming Chan, Douliu (TW); San-Bei Huang, Douliu (TW); Tsung-Sheng Huang, Douliu (TW); Kuo-Hung Lee, Douliu (TW)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/196,791

(22) Filed: May 12, 2023

(65) Prior Publication Data

US 2023/0278736 A1 Sep. 7, 2023

Related U.S. Application Data

(62) Division of application No. 17/030,777, filed on Sep. 24, 2020, now Pat. No. 11,697,516, which is a (Continued)

(51) Int. Cl.
*B65B 25/20* (2006.01)
*B65B 5/06* (2006.01)
(Continued)

(52) U.S. Cl.
CPC ..... *B65B 25/20* (2013.01); *B65B 5/06* (2013.01); *B65B 5/108* (2013.01); *B65B 11/02* (2013.01);
(Continued)

(58) Field of Classification Search
CPC ..... B65B 5/06; B65B 11/025; B65B 35/36; B65B 35/44; B65B 45/00; B65B 57/12; B65B 59/02; B65B 41/12; B65B 2210/04
See application file for complete search history.

(56) References Cited

U.S. PATENT DOCUMENTS 1,064,964 A 6/1913 Dooley et al.
1,129,975 A 3/1915 Giroud et al.
(Continued)

FOREIGN PATENT DOCUMENTS

CN 205256757 U 5/2016
CN 106136427 A 11/2016
(Continued)

OTHER PUBLICATIONS

DB Shoes:, "Manufacturing a Pair of Shoes—DB Shoes Ltd", XP054978576, Available Online at: <https://www.youtube.com/watch?v=EM-D4CQc5Ok>, Sep. 9, 2010, 2 pages.

*Primary Examiner* — Lucas E. A. Palmer
(74) *Attorney, Agent, or Firm* — Shook, Hardy & Bacon L.L.P.

(57) ABSTRACT

Systems and processes for packing complementary articles of footwear into a container are disclosed. The processes can include utilizing a reusable packing sheet positioned underneath complementary articles of footwear to transfer the complementary articles of footwear into a container. The processes can also include removing the reusable packing sheet from underneath the complementary articles of footwear while the complementary articles of footwear remain positioned in the container. Additional processes can include aligning and sizing complementary articles of footwear for packing in a container.

20 Claims, 15 Drawing Sheets

Related U.S. Application Data division of application No. 15/991,331, filed on May 29, 2018, now Pat. No. 10,822,128.

(60) Provisional application No. 62/512,959, filed on May 31, 2017.

(51) Int. Cl.

| | |
|---|---|
| ***B65B 5/10*** | (2006.01) |
| ***B65B 11/02*** | (2006.01) |
| ***B65B 35/36*** | (2006.01) |
| ***B65B 35/44*** | (2006.01) |
| ***B65B 35/58*** | (2006.01) |
| ***B65B 41/04*** | (2006.01) |
| ***B65B 41/12*** | (2006.01) |
| ***B65B 41/14*** | (2006.01) |
| ***B65B 45/00*** | (2006.01) |
| ***B65B 49/12*** | (2006.01) |
| ***B65B 57/12*** | (2006.01) |
| ***B65B 59/00*** | (2006.01) |
| ***B65B 59/02*** | (2006.01) |
| ***B65B 65/06*** | (2006.01) |

(52) U.S. Cl.

CPC ..... *B65B 11/025* (2013.01); *B65B 35/36* (2013.01); *B65B 35/44* (2013.01); *B65B 35/58* (2013.01); *B65B 41/04* (2013.01); *B65B 41/14* (2013.01); *B65B 45/00* (2013.01); *B65B 49/12* (2013.01); *B65B 57/12* (2013.01); *B65B 59/001* (2019.05); *B65B 59/003* (2019.05); *B65B 59/02* (2013.01); *B65B 65/06* (2013.01); *B65B 5/105* (2013.01); *B65B 5/106* (2013.01); *B65B 41/12* (2013.01); *B65B 2210/04* (2013.01)

(56) References Cited

U.S. PATENT DOCUMENTS

| | | | | | |
|---|---|---|---|---|---|
| 1,543,296 | A | | 6/1925 | Peters et al. | |
| 1,858,189 | A | | 5/1932 | Downing | |
| 2,376,003 | A | | 5/1945 | Palmer | |
| 2,486,892 | A | | 11/1949 | Sumida | |
| 2,699,022 | A | | 1/1955 | Wollett | |
| 2,943,429 | A | | 7/1960 | Vactor et al. | |
| 2,994,168 | A | | 8/1961 | Bercaw et al. | |
| 3,038,284 | A | | 6/1962 | Kaestner | |
| 3,046,715 | A | | 7/1962 | Kent et al. | |
| 3,290,855 | A | * | 12/1966 | Brinck | B65B 25/20 53/445 |
| 3,653,175 | A | * | 4/1972 | Rogiers | B29C 51/18 53/559 |
| 3,750,916 | A | * | 8/1973 | Stringer | B65B 25/20 223/37 |
| 3,803,990 | A | * | 4/1974 | Pedersen | B65D 33/08 493/227 |
| 3,841,055 | A | | 10/1974 | Takami | |
| 3,915,282 | A | * | 10/1975 | Remensperger | A21C 9/085 198/456 |
| 4,180,962 | A | | 1/1980 | Michels | |
| 4,348,145 | A | | 9/1982 | Marklund et al. | |
| 4,501,106 | A | | 2/1985 | Treiber et al. | |
| 4,583,348 | A | * | 4/1986 | Treiber | B65B 11/54 53/556 |
| 4,679,379 | A | | 7/1987 | Cassoli | |
| 4,788,812 | A | | 12/1988 | Morita et al. | |
| 5,127,212 | A | | 7/1992 | Johnsen et al. | |
| 5,144,787 | A | * | 9/1992 | Whitby | B65B 11/54 53/66 |
| 5,205,104 | A | | 4/1993 | Nakashima et al. | |
| 5,379,574 | A | | 1/1995 | Fischer et al. | |
| 5,383,326 | A | | 1/1995 | Dean et al. | |
| 5,502,954 | A | * | 4/1996 | Akiyama | B65B 49/08 53/76 |
| 5,528,881 | A | | 6/1996 | Cappi et al. | |
| 5,644,895 | A | * | 7/1997 | Edwards | B29C 66/8163 53/64 |
| 5,701,719 | A | | 12/1997 | Neukam | |
| 6,098,375 | A | * | 8/2000 | Button | B65B 43/39 53/247 |
| 6,109,007 | A | * | 8/2000 | Combs | B65B 11/16 53/223 |
| 6,170,236 | B1 | * | 1/2001 | Whitby | B65B 35/24 53/556 |
| 6,189,302 | B1 | | 2/2001 | Kudo et al. | |
| 6,336,308 | B1 | | 1/2002 | Kokkersvold et al. | |
| 7,040,076 | B2 | | 5/2006 | Lachenmeier et al. | |
| 8,015,781 | B2 | | 9/2011 | Kent | |
| 8,327,611 | B2 | * | 12/2012 | Carmelo Calvano | B65B 9/213 53/551 |
| 8,636,137 | B2 | * | 1/2014 | Weber | B65G 47/24 198/572 |
| 2004/0026292 | A1 | | 2/2004 | Ours et al. | |
| 2006/0272283 | A1 | * | 12/2006 | Kawanishi | B65B 11/54 53/76 |
| 2007/0209327 | A1 | * | 9/2007 | Kent | B65B 25/046 53/553 |
| 2009/0109275 | A1 | * | 4/2009 | Hosen | B41J 2/435 347/264 |
| 2010/0192515 | A1 | * | 8/2010 | Chalendar | B65B 35/56 53/493 |
| 2011/0197547 | A1 | | 8/2011 | Yuyama et al. | |
| 2012/0137636 | A1 | * | 6/2012 | Ours | B65B 43/58 493/51 |
| 2014/0100098 | A1 | * | 4/2014 | Dahl | B65H 43/08 493/23 |
| 2017/0129632 | A1 | * | 5/2017 | Williams | B65B 51/26 |
| 2018/0346166 | A1 | * | 12/2018 | Chang | B65B 59/003 |
| 2019/0002148 | A1 | * | 1/2019 | Stollery | B65B 25/20 |
| 2021/0009293 | A1 | | 1/2021 | Chang et al. | |
| 2021/0204656 | A1 | * | 7/2021 | Ahn | B05B 12/122 |

FOREIGN PATENT DOCUMENTS

| | | | |
|---|---|---|---|
| CN | 205854576 | U | 1/2017 |
| FR | 3013035 | A1 | 5/2015 |
| JP | 10-99104 | A | 4/1998 |

* cited by examiner

SYSTEMS AND PROCESSES FOR PACKING ARTICLES OF FOOTWEAR

CROSS-REFERENCE TO RELATED APPLICATIONS

This application claims is a Divisional of U.S. patent application Ser. No. 17/030,777, filed Sep. 24, 2020, and entitled "SYSTEMS AND PROCESSES FOR PACKING ARTICLES OF FOOTWEAR,", which is a divisional of U.S. patent application Ser. No. 15/991,331 U.S. Pat. No. 10,822,128 Patented on May 29, 2018 which claims priority from the U.S. Provisional Application 62/512,959, filed May 31, 2017, and entitled "SYSTEMS AND PROCESSES FOR PACKING ARTICLES OF FOOTWEAR," the entire contents of which is incorporated by reference herein.

TECHNICAL FIELD

The present disclosure relates to packing articles of footwear. More particularly, the present disclosure relates to systems and processes for packing articles of footwear.

BACKGROUND

Traditional methods of packing articles of footwear for consumer presentation include manually wrapping the articles of footwear with tissue paper and manually placing them into a container. However, such methods are prone to inefficiencies with respect to the alignment of the articles of footwear and proper material selection.

BRIEF DESCRIPTION OF THE DRAWINGS

Illustrative aspects of the present invention are described in detail below with reference to the attached drawing figures, which are incorporated by reference herein and wherein.

DESCRIPTION

Figure 1:
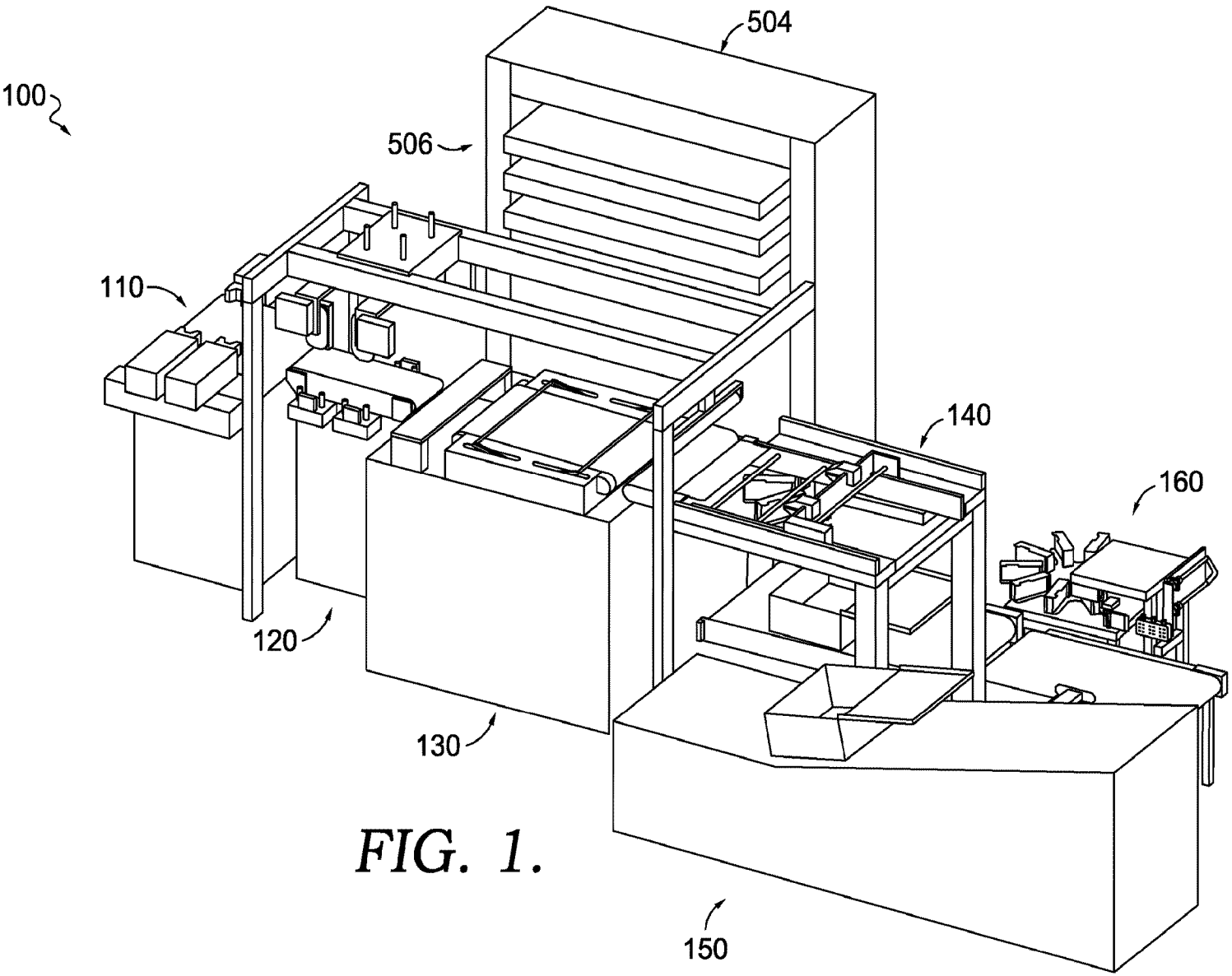
FIG. 1 is a top and side perspective view of an exemplary system for packing complementary articles of footwear into a container, including an alignment station, a sizing station, a wrapping station, a transfer station, a container labeling system, and a container conveyance system, in accordance with aspects hereof.

In general, aspects herein are directed to systems and methods for packing articles of footwear. Traditionally, complementary articles of footwear are manually wrapped in tissue paper and placed inside a container for consumer presentation. However, these manually performed processes can be time consuming and result in inefficiencies due to improper alignment of the articles of footwear when wrapping or packing, and/or due to improper material selection, such as improper container size and/or tissue paper size. In addition, the improper material selections can result in additional waste materials.

Certain methods for packing articles of footwear rely on mechanical components for transferring articles of footwear into a container. However, using mechanical components for such tasks is complicated by the minimal margins between the container edges and the size of the articles of footwear and tissue paper. Stated differently, articles of footwear are packed in containers with slim margins for minimizing packing materials and for securing the articles of footwear within the container, and this makes it challenging for a mechanical device to transfer the articles of footwear into the container, without damaging the tissue paper or articles of footwear.

The processes and systems disclosed herein can alleviate one or more problems discussed above. In aspects, at a high level, the systems and processes disclosed herein provide a system for aligning complementary articles of footwear and wrapping them in a packing material, and transferring the complementary articles of footwear into a container via the use of a pliable reusable packing sheet, with less error, greater efficiency, and reduced waste compared to traditional packing processes.

In certain aspects, the processes described herein can utilize a light source to aid in aligning complementary articles of footwear on a conveyance apparatus, e.g., by identifying the desired position for the apex of the heel end or toe end of each the complementary articles of footwear. In such aspects, the complementary articles of footwear can be placed on the conveyance system on their outsoles, which allows for better alignment and stability for downstream processes, such as sizing and transferring to the packing material. Further, prior to being conveyed to downstream processes, moveable alignment members can contact the complementary articles of footwear to ensure that the complementary articles of footwear are properly positioned and aligned on the conveyance apparatus.

In various aspects, the properly aligned complementary articles of footwear can be transferred to the sizing station, where the size of the complementary articles of footwear are determined, e.g., mechanically and/or optically. In such aspects, by determining the size of the complementary articles of footwear the appropriate sized packing material, e.g., tissue paper, can be selected for further downstream packing processes. In such aspects, mechanically or optically detecting the size of the complementary articles of footwear and determining the appropriate size for the packing material eliminates waste and error compared to the manual processes discussed above. Further, in certain aspects, the appropriately sized packing material can be retrieved and positioned on the wrapping station as the complementary articles of footwear are transferred from the sizing station to the wrapping station, which can lead to greater packing efficiency.

In various aspects, the transfer members utilized to transfer the complementary articles of footwear from the sizing station to the wrapping station can rotate about an axis transverse to the lateral direction of movement of the transfer members so the complementary articles of footwear can be rotated to be placed on the packing material on their lateral or medial side, for the proper orientation for packing in a container. In such aspects, utilizing a single transfer member that shifts vertically and laterally, and rotates to change the orientation of the articles of footwear can increase efficiency and reduce the amount of components required to handle the complementary articles of footwear.

In certain aspects, the complementary articles of footwear are at least partly covered or wrapped in the packing material and transferred to the transfer station for packing in a container. In such aspects, the complementary articles of footwear are positioned on a reusable packing sheet that has been extended out over a container. Further in such aspects, the tension in the reusable packing sheet can be controlled, e.g., via sheet extension members and/or a pressing member, so as to control dropping of the complementary articles of footwear into the container. In such aspects, utilizing the reusable packing sheet to lower the complementary articles of footwear into the container, allows for efficiently and safely placing the complementary articles of footwear into the container without the use of mechanical calipers or grabbers that would not fit inside the container due to the tight margins between the interior dimensions of the container and the size of the complementary articles of footwear.

In various aspects, once the complementary articles of footwear are placed inside the container, the reusable packing sheet can be retracted back to the packing sheet source for re-use. In such aspects, the reusable packing sheet has a low coefficient of static friction, e.g., less than about 0.4, to allow for the ease of movement from under the complementary articles of footwear without disrupting their position within the container. Further, in such aspects, since the reusable packing sheet is retracted back it can be re-used for packing additional complementary articles of footwear, thereby reducing waste in the packing process.

Accordingly, in one aspect a method of packing complementary articles of footwear is provided. The method includes utilizing one or more sheet extension members to contact and extend a reusable packing sheet out from a packing sheet source to a distal point so that the reusable packing sheet extends from the packing sheet source past first and second guiding members to the distal point. The bottom side of the reusable packing sheet faces the first and second guiding members. Further, the method includes positioning first and second complementary articles of footwear on a top side of the reusable packing sheet at a position between the first and second guiding members while tension in the reusable packing sheet at least between the first and second guiding members is sufficient to maintain at least a portion of the first and second complementary articles of footwear positioned above the first and second guiding members. The method also includes, subsequent to the positioning the first and second complementary articles of footwear on the top side of the reusable packing sheet, reducing tension in the reusable packing sheet so that the first and second complementary articles of footwear vertically shift below the first and second guiding members and into a container.

In another aspect, a method of aligning complementary articles of footwear for packing is provided. The method includes placing first and second complementary articles of footwear on a conveyance apparatus so that an outsole of each of the first and second complementary articles of footwear contacts the conveyance apparatus. The method further includes directing a light source onto each of the first and second complementary articles of footwear to identify the desired location of an apex position of a toe end or a heel end of each of the first and second complementary articles of footwear on the conveyance apparatus. Additionally, the method includes contacting each of the first and second complementary articles of footwear with one or more moveable alignment members to align each of the first and second complementary articles of footwear so that an axis extending from the toe end to the heel end of the first complementary article of footwear is substantially parallel to an axis extending from the toe end to the heel end of the second complementary article of footwear.

In another aspect, a system for packing complementary articles of footwear into a container is provided. The system includes a first conveyance apparatus sized to transport first and second complementary articles of footwear. The system also includes one or more moveable alignment members. Each of the one or more moveable alignment members having first and second contacting components positioned on opposing sides of the first conveyance apparatus. The first and second contacting components are moveable towards or away from one another, for contacting or releasing from contact one of the first and second complementary articles of footwear. Further, the system includes first and second transfer members that are vertically and laterally shiftable. Each of the first and second transfer members includes first and second contacting components that are rotatable about an axis that is transverse to a lateral movement direction of the first and second transfer members. The system also includes a packing sheet source that includes a reusable packing sheet. Additionally, the system includes first and second guiding members laterally spaced apart from the packing sheet source at fixed positions so that the first guiding member is positioned between the packing sheet source and the second guiding member. Further, the system includes one or more sheet extension members. The one or more sheet extension members are shiftable from a first position where the one or more extension members are positioned between the packing sheet source and the first guiding member to a second position where the first and second guiding members are positioned between the packing sheet source and the one or more sheet extension members.

Turing now to the Figures, and FIG. 1 in particular, a system 100 for packing complementary articles of footwear into a container is depicted. In the aspect depicted in FIG. 1, the system can include an alignment station 110, a sizing station 120, a wrapping station 130, a transfer station 140, a container conveyance system 150, and a container labeling system 160. As used herein, the term complementary articles of footwear refers to a set of footwear to be worn by a wearer on the wearer's left and right feet, e.g., a pair of footwear.

In certain aspects, complementary articles of footwear are sequentially processed at the alignment station 110 for proper alignment with respect to each other and the system components and stations, transferred to the sizing station 120 for determining the size of the complementary articles of footwear. Further, in such aspects, the complementary articles of footwear are transferred from the sizing station 120 to the wrapping station 130, where the complementary articles of footwear are at least partly covered in a packing material. Still further, in such aspects, the complementary articles of footwear are transferred from the wrapping station 130 to the transfer station 140 where the complementary articles of footwear are transferred into a container. Further, in such aspects, the container labeling system 160 can apply a label to the container. Additionally, in such aspects, the container conveyance system 150 may transport a container to the transfer station 140 from the container conveyance system 150 and/or transport away the container from the transfer station 140 after the complementary articles of footwear have been placed inside the container. Each of the stations and systems of the system 100 of FIG. 1 are described in detail below.

As can be seen in the aspect depicted in FIG. 1, the stations 110, 120, 130, and 140 are generally positioned in a linear manner. For example, the alignment station 110 and the wrapping station 130 are positioned on opposing sides of the sizing station 120, and the sizing station 120 and the transfer station 140 are positioned on opposing sides of the wrapping station 130. This linear positioning of the stations 110, 120, 130, and 140 is just one exemplary configuration for the system 100. Other configurations and orientations of the stations 110, 120, 130, and 140 are also contemplated by the processes and systems described herein. For example, in an alternative aspect, the stations 110, 120, 130 and 140 may extend along a radial path.

Figure 2:
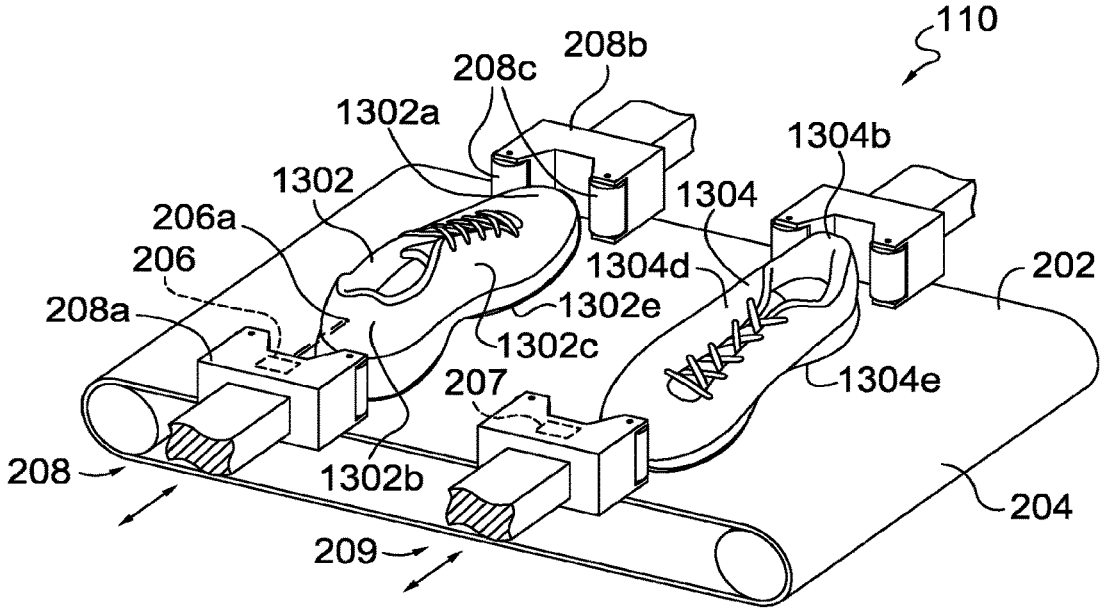
FIG. 2 is a top and side perspective view of an alignment station, showing complementary articles of footwear, a conveyance apparatus, a light source, and moveable alignment members, in accordance with aspects hereof.
Figure 13:
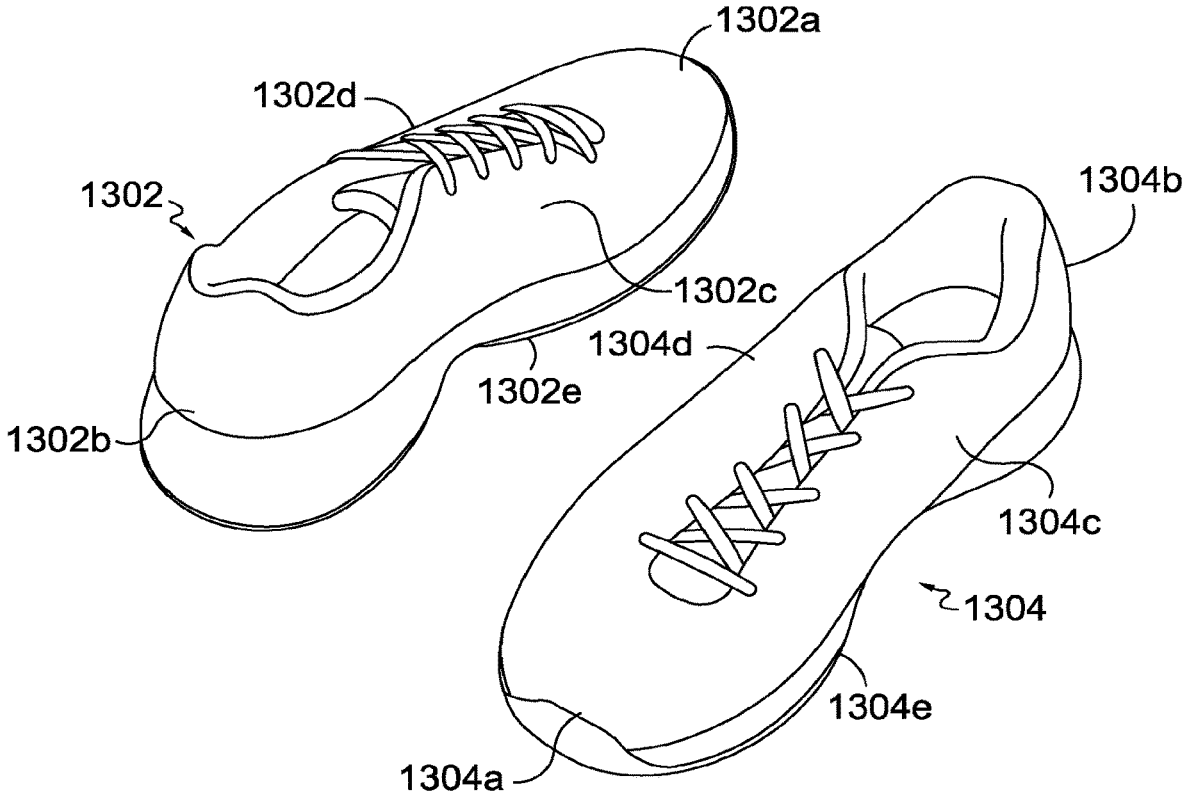
FIG. 13 is a top and perspective view of complementary articles of footwear, in accordance with aspects hereof.

FIG. 2 depicts a close up view of the alignment station 110 of FIG. 1. As discussed above, in certain aspects, complementary articles of footwear, e.g., the complementary articles of footwear 1302 and 1304 are placed on a conveyance apparatus 202. For reference, FIG. 13 depicts exemplary complementary articles of footwear 1302 and 1304. Each of the complementary articles of footwear 1302 and 1304 include a toe end 1302*a* and 1304*a*, and a heel end 1302*b* and 1304*b*, respectively. Further, each of the complementary articles of footwear 1302 and 1304 include a medial side 1302*c* and 1304*c*, and a lateral side 1302*d* and 1304*d*, respectively. Additionally, each of the complementary articles of footwear 1302 and 1304 includes an outsole 1302*e* and 1304*e*, respectively. It should be understood that the complementary articles of footwear depicted in FIG. 13 are exemplary and other types of articles of footwear are also contemplated by the disclosure herein including, but not limited to boots, sandals, dress shoes, and slippers. Throughout the description herein, reference will be made to the complementary articles of footwear 1302 and 1304 depicted in FIG. 13 and any respective parts or components.

Returning back to the alignment station 110 of FIG. 2, in certain aspects, the complementary articles of footwear 1302 and 1304 can be placed on the conveyance apparatus 202 manually or in an automated manner via an upstream conveyance system. In aspects, the conveyance apparatus 202 can be any type of conventional conveyance apparatus, such as a motorized belt.

As can be seen in the aspect depicted in FIG. 2, the complementary articles of footwear 1302 and 1304 are placed on the conveyance apparatus 202 so that the outsoles 1302*e* and 1304*e*, respectively, are contacting the conveyance apparatus 202, such as an outer surface of a moveable component 204 of the conveyance apparatus 202. In certain aspects, the outsoles 1302*e* and 1304*e* can provide a rigid and/or substantially flat surface (of at least a portion of the outsoles 1302*e* and 1304*e*) for maintaining stability on the conveyance apparatus 202 to allow for more effective alignment and when being transported by the conveyance apparatus 202.

In certain aspects, the complementary articles of footwear are positioned on the conveyance apparatus 202 so that a medial side 1302*c* of the complementary article of footwear 1302 faces a lateral side 1304*d* of the complementary article of footwear 1304. In the same or alternative aspects, the complementary articles of footwear 1302 and 1304 can be placed in a heel to toe manner. For example, in such aspects, a toe end 1302*a* of the complementary article of footwear 1302 is positioned adjacent a heel end 1304*b* of the complementary article of footwear 1304.

It various aspects, it may be desirable to utilize a visual guide for placing the complementary articles of footwear on the conveyance apparatus 202, e.g., to identify a desired general or specific location for a specific portion of the complementary articles of footwear on the conveyance apparatus 202. For example, as can be seen in FIG. 2, in certain aspects, a light source 206 can direct light in a direction transverse to the direction of extension of the conveyance apparatus 202 in order to identify a desired location of an apex position of a heel end or toe end of the complementary articles of footwear when placed on the conveyance apparatus 202. In this example, as depicted in FIG. 2, the light source 206 is directing light onto an apex position 206*a* of heel end 1302*b* of the complementary article of footwear 1302. The apex position of the heel end refers to the extent of the heel end, which in some cases may generally correlate to the center of the heel end. Similarly, the apex position of the toe end refers to the extent of the toe end, which in some cases may generally correlate to the center of the toe end. In aspects, the light source can be any type of light source, such as a laser light source.

As can be seen in the aspect depicted in FIG. 2, the light source 206 can be coupled to another component at the alignment station 110, such as the moveable alignment member 208. In certain other aspects, the light source 206 can be placed elsewhere at the alignment station 110, such as above the conveyance apparatus 202, to provide a line of light for both the apex of a toe end and of a heel end to line up with. It should be understood that while the light source 206 and the moveable alignment member 208 are described the same parameters equally apply to the light source 207 and the moveable alignment member 209.

As can be seen in the aspect depicted in FIG. 2, the moveable alignment member 208 can include contacting components 208*a* and 208*b*, respectively, positioned on opposing sides of the conveyance apparatus 202. In aspects, the contacting components 208*a* and 208*b* can move towards or away from one another so that as the contacting components 208*a* and 208*b* move towards one another they contact a heel end 1302*b* and a toe end 1302*a*, respectively. In certain aspects, such as that depicted in FIG. 2, the contacting components 208*a* and 208*b* can be concave shaped to receive a portion of the toe end or heel end for a more efficient alignment process. In the same or alternative aspects, one or both of the contacting components 208*a* and 208*b* can also include one or more curved surfaces 208*c*, e.g., rollers, to facilitate the engagement with the toe end 1302*a*.

Figure 3:
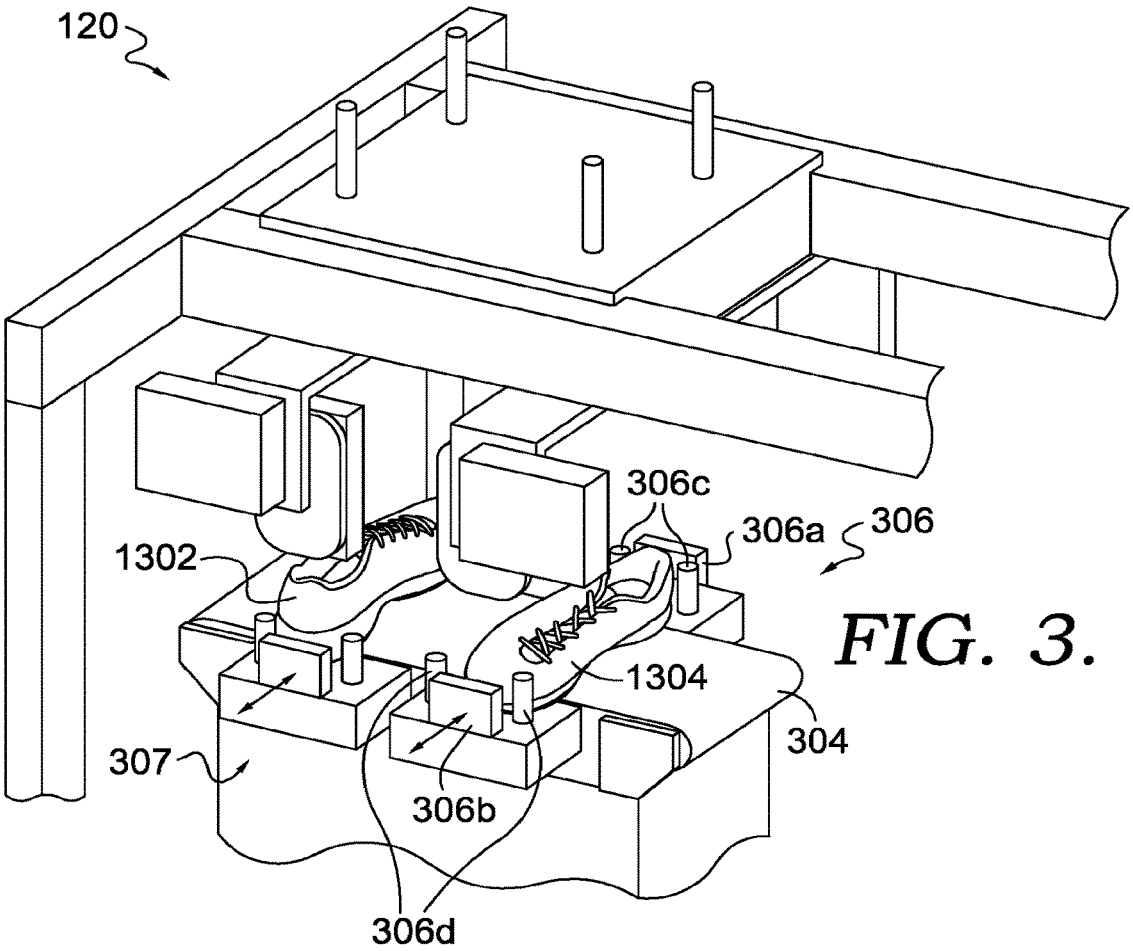
FIG. 3 is a top and side perspective view of a sizing station, showing complementary articles of footwear on a conveyance apparatus engaging sizing members with transfer members positioned above the complementary articles of footwear, in accordance with aspects hereof.
Figure 4:
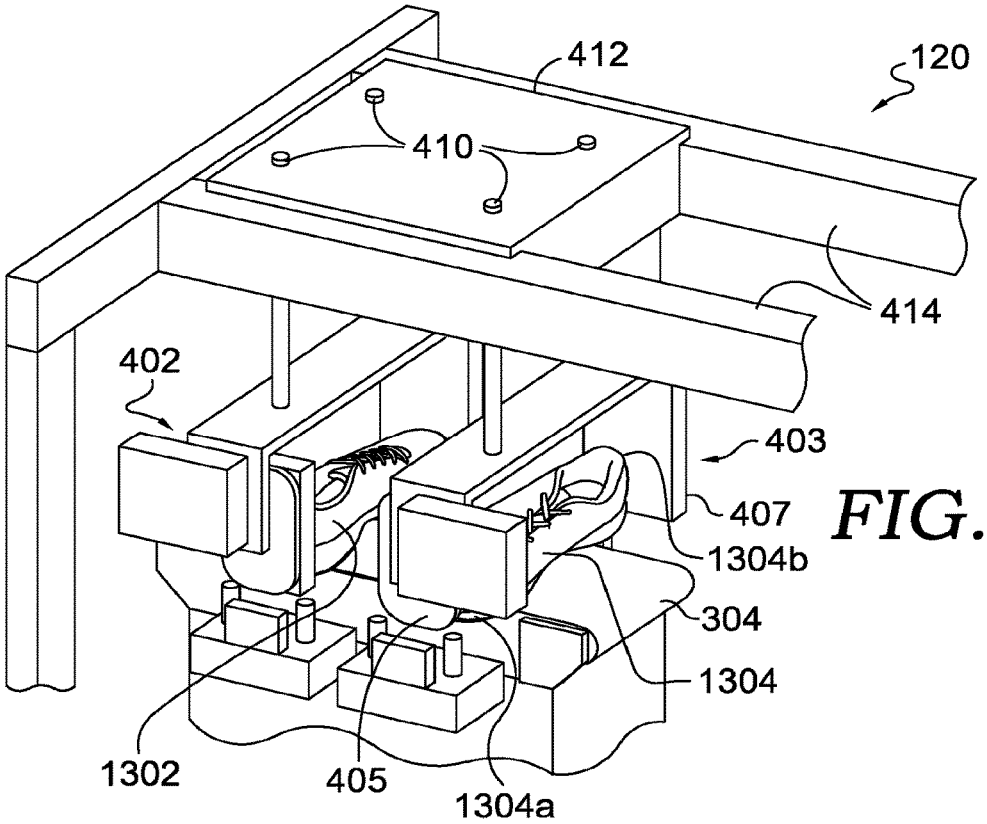
FIG. 4 is a top and side perspective view of the sizing station of FIG. 3, showing the transfer members engaging and lifting up the complementary articles of footwear, in accordance with aspects hereof.

In certain aspects, once the complementary articles of footwear are aligned, e.g., via one or more moveable alignment members, the complementary articles of footwear are transported to the sizing station 120. An aspect of a sizing station 120 is depicted in FIGS. 3 and 4. In aspects, the complementary articles of footwear can be transported to the sizing station via the conveyance apparatus 202 depicted in FIG. 2. For example, the complementary articles of footwear can be transported along the conveyance apparatus 202 of the alignment station 110 and transferred to the conveyance apparatus 304 of the sizing station 120 of FIGS. 3 and 4. While, in the aspect depicted in the figures, the conveyance apparatus of the alignment station 110 and the conveyance apparatus 304 of the sizing station 120 are depicted as separate apparatuses, in certain aspects a single conveyance apparatus can be shared between the alignment station 110 and the sizing station 120. The conveyance apparatus 202 can include any conventional type of conveyance system, such as a motorized conveyance belt.

In aspects, at the sizing station 120, the size of the complementary articles of footwear can be determined. Any size determination mechanism can be utilized to determine the size of the complementary articles of footwear. In one aspect, the size of the complementary articles of footwear can be determined mechanically. For example, as can be seen in FIG. 3, a sizing member 306 can be used to mechanically determine the size of the complementary articles of footwear.

In certain aspects, the sizing member 306 can include size contacting components 306*a* and 306*b* positioned on opposing sides of the conveyance apparatus 304. In such aspects, the size contacting components 306*a* and 306*b* can move towards and away from one another to engage or disengage the complementary article of footwear 1304. In aspects, the size contacting components 306*a* and 306*b* can be associated with a set of guides 306*c* and 306*d*, respectively, for setting and capturing the complementary article of footwear 1304 prior to, or while, the size contacting components 306*a* and 306*b* engaging or contacting the heel end 1304*b* and the toe end 1304*a*, respectively.

The mechanical contacting of the complementary article of footwear 1304 by the size contacting components 306*a* and 306*b* can be converted into the size of the complementary article of footwear 1304 in any manner known to one skilled in the art. For example, in aspects, a sensor, not depicted in the figures, can detect the amount of movement of the size contacting components 306*a* and 306*b* to contact the complementary article of footwear 1304, which can then be correlated to a size of the complementary article of footwear 1304. In certain aspects, a sizing member, such as sizing member 307, can be utilized to determine the size of the complementary article of footwear 1302. In such aspects, the sizing member 307 can include any or all of the parameters and components as those described above with reference to the sizing member 306.

In alternative aspects, the size of the complementary articles of footwear 1302 and 1304 can be determined optically. For example, in one aspect, one or more of the complementary articles of footwear 1302 and 1304 can be scanned by a laser for determining the size of the complementary articles of footwear 1302 and 1304. In another aspect, a camera and software may be utilized to determine the size of the complementary articles of footwear 1302 and 1304.

In certain aspects, subsequent to determining the size of the complementary articles of footwear 1302 and 1304, the complementary articles of footwear 1302 and 1304 can be transferred to the wrapping station 130 so that at least a portion of the complementary articles of footwear 1302 and 1304 can be covered or wrapped in a packing material prior to being transferred to a container. For example, as can be seen in FIG. 4, transfer members 402 and 403 can engage and move the complementary articles of footwear 1302 and 1304, respectively. While the foregoing description is focused on the transfer member 403, it should be understood that the same description equally applies to the transfer member 402, unless otherwise specified.

In certain aspects, the transfer member 403 can move vertically and laterally to pick up and transport the complementary article of footwear 1304 to the wrapping station 130. In various aspects, the transfer member 403 can include contacting components 405 and 407 to contact the toe end 1304*a* and the heel end 1304*b* of the complementary article of footwear 1304, respectively, in such a manner to be able to vertically lift the complementary article of footwear 1304 up from the conveyance apparatus 304. The transfer member 403 can vertically move using any mechanism known to one skilled in the art. In one aspect, the transfer member 403 can be coupled to one or more support posts 410 which can be shifted up and down via a motor assembly 412.

Once the transfer member 403 has moved or commences moving the complementary article of footwear 1304 vertically away from the conveyance apparatus 304, the transfer member 403 can move laterally towards the wrapping station 130. The transfer member 403 can laterally move in any manner known to one skilled in the art. In certain aspects, the transfer member 403 can traverse along a track 414 that extends from the sizing station 120 to the wrapping station 130.

Figure 5:
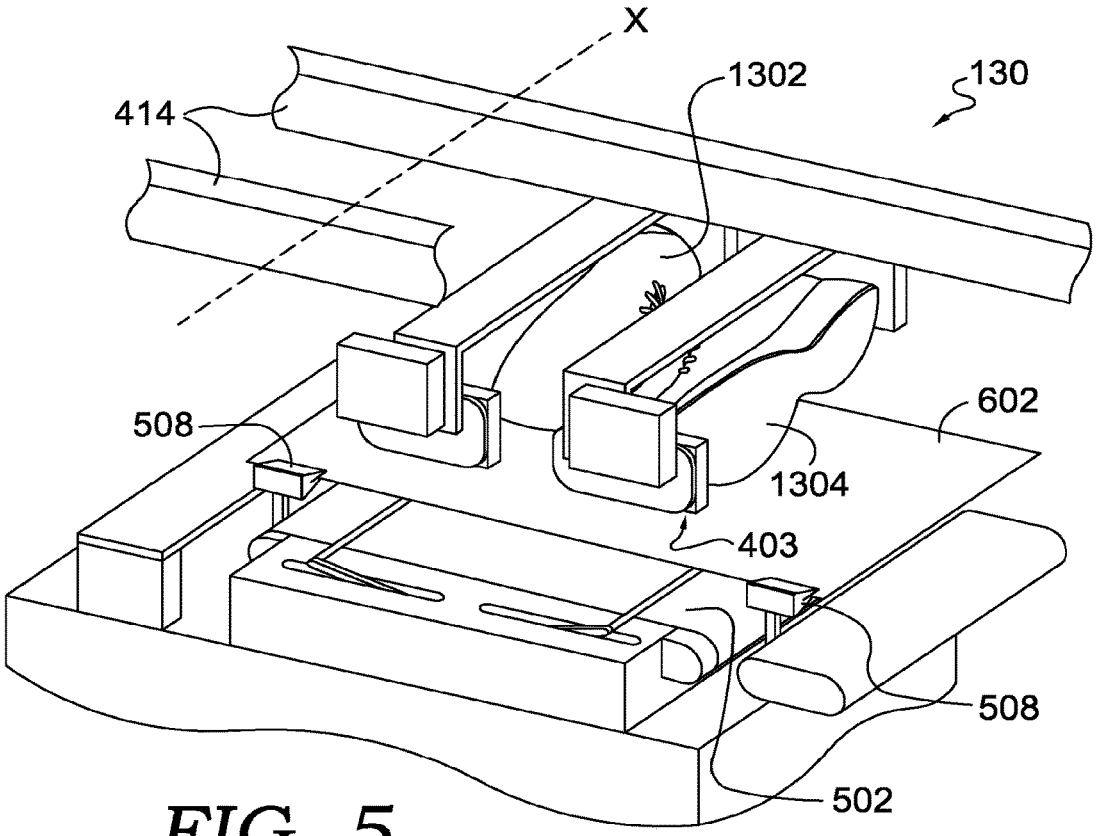
FIG. 5 is a top and side perspective view of a wrapping station, showing the complementary articles of footwear rotated about the axis X while in contact with the transfer members, in accordance with aspects hereof.
Figure 7:
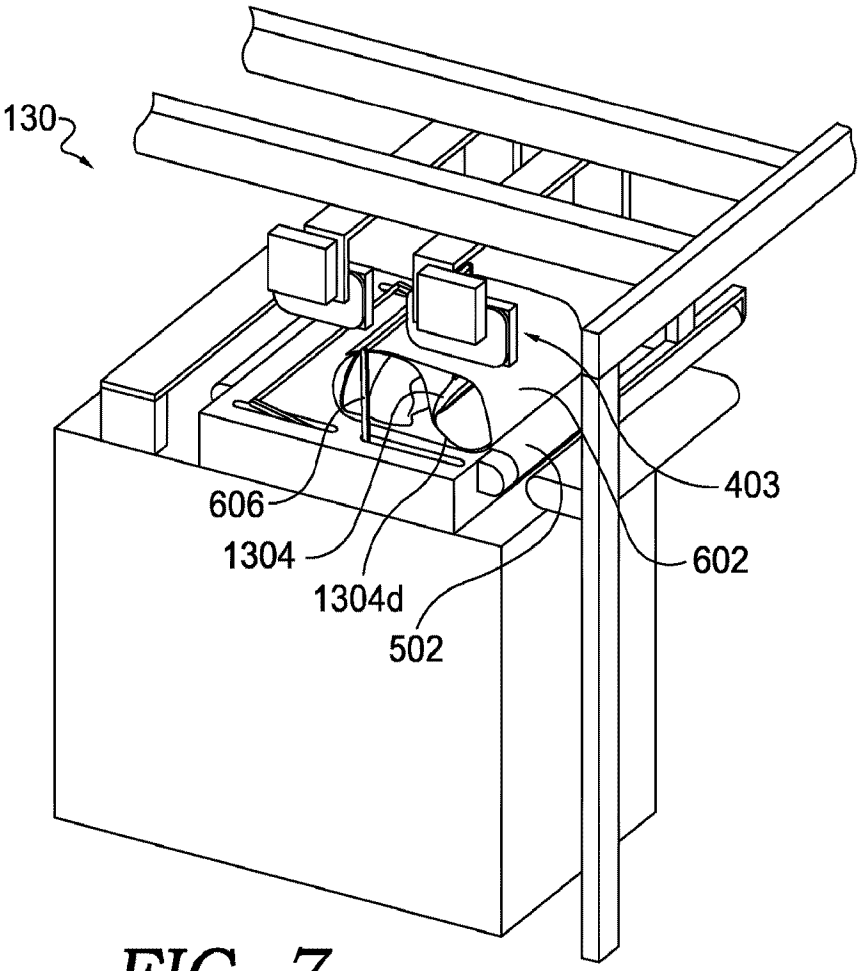
FIG. 7 is a top and side perspective view of the wrapping station of FIG. 6, showing a second complementary article of footwear positioned on a packing material located on a conveyance system with a portion of the packing material placed over the article of footwear by the wrapping member, in accordance with aspects hereof.
Figure 6:
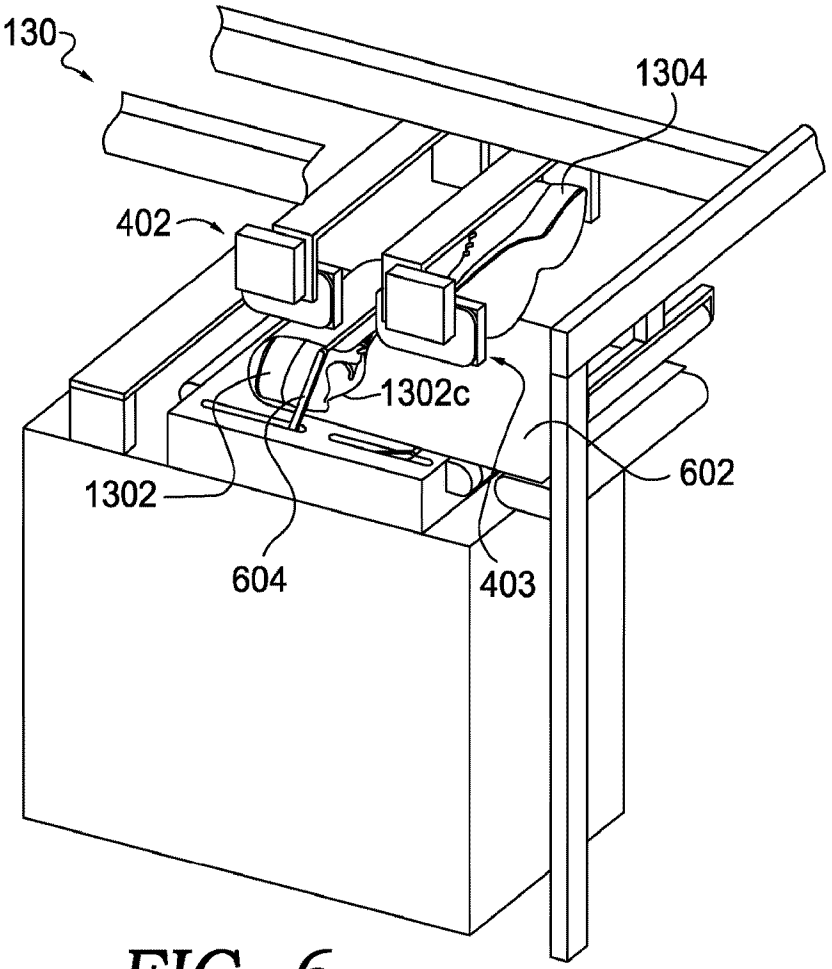
FIG. 6 is a top and side perspective view of a wrapping station, showing a first complementary article of footwear positioned on a packing material located on a conveyance system with a portion of the packing material placed over the article of footwear by the wrapping member, in accordance with aspects hereof.

FIGS. 5-7 depict a view of the wrapping station 130. As can best be seen in FIG. 5, the transfer member 403 has laterally moved along the track 414 to the wrapping station 130. In various aspects, in order to properly wrap the complementary articles of footwear in the packing material 602, a lateral or medial side of the complementary articles of footwear can be placed onto the packing material 602. In such aspects, the transfer member 403 can be configured to shift the position of the complementary article of footwear 1304 so it is properly oriented for having a lateral side or a medial side contact the packing material 602. For example, in certain aspects, the transfer member 403 and/or the contacting components 405 and 407 are rotatable about an axis X, as depicted in FIG. 5, which is transverse to the track 414 and to the direction of extension of the conveyance apparatus 502.

In certain aspects, the complementary article of footwear 1304 can be rotated by the transfer member 403 while the transfer member 403 is laterally moving to the complementary article of footwear 1304 to the wrapping station 130 or after the complementary article of footwear 1304 is positioned over the wrapping station 130.

In various aspects such as that depicted in FIGS. 5-7, the packing material 602 can be selected and positioned on a conveyance apparatus 502 at the wrapping station 130 prior to the complementary articles of footwear 1302 and 1304 being positioned on the packing material 602.

As discussed above, in certain aspects, the size of the complementary articles of footwear can be determined in order to select the appropriate sized packing material for use at the wrapping station 130. In such aspects, once the size of the complementary article of footwear is determined, e.g., at the sizing station 120, the appropriate sized packing material can be obtained from one of a plurality of packing material sources.

A plurality of packing material sources 504 is best seen in FIG. 1. The plurality of packing material sources 504 depicted in FIG. 1 includes a plurality of shelves 506 each housing different sizes of packing material. In one aspect, the plurality of packing material sources 504, or a controller that is not depicted in the figures, can be in electronic or wireless communication with at least a portion of the sizing station 120 so that the size of the complementary articles of footwear 1302 and 1304 can be communicated to the plurality of packing material sources 504. In such aspects, one of the plurality of shelves 506 can be shifted to the appropriate position so placement members 508 can contact the appropriate sized packing material, e.g., the packing material 602, and position it over the conveyance apparatus 502. The packing material can be any type of commercially available packing material or paper. In one aspect, the packing material can include tissue paper. It should be understood that other configurations for a plurality of packing material sources and for transferring the appropriate sized packing material to the conveyance apparatus are also contemplated and one skilled in the art can utilize other configurations or packing material systems for a specific purpose.

As discussed above, once the packing material 602 is positioned on the conveyance apparatus 502, the complementary articles of footwear 1302 and 1304 can be placed on the packing material 602 and at least partly wrapped or covered with the packing material 602. In such aspects, the respective transfer member 402 or 403 can lower the complementary article of footwear onto the packing material 602. In one or more aspects, it may be desirable to wrap each complementary article of footwear sequentially. For example, as can be seen in FIG. 6, the medial side 1302*c* of the complementary article of footwear 1302 is positioned on the packing material 602, while the complementary article of footwear 1304 is still engaged with the transfer member 403 and positioned above the packing material 602.

In the aspect depicted in FIG. 6, a portion of the packing material is placed over at least a portion of the complementary article of footwear 1302, e.g., via the radial movement of a wrapping member 604. In such aspects, the wrapping member 604 can radially shift from a resting position on one side of the complementary article of footwear 1302 to the other side and as the wrapping member shifts to the other side of the complementary article of footwear 1302, a portion of the packing material is draped across at least a portion of the complementary article of footwear 1302. Further, in such aspects, after the packing material is draped across at least a portion of the complementary article of footwear, the wrapping member 604 can radially shift back to the resting position.

As depicted in FIG. 7, once the packing material 602 is positioned over the complementary article of footwear 1302, the complementary article of footwear 1304 can be placed on the packing material 602, e.g., via the vertical movement of the transfer member 403. In such aspects, the lateral side 1304*d* of the complementary article of footwear 1304 can be in contact with the packing material 602. In various aspects, the complementary article of footwear 1304 can be positioned to hold in place at least a portion of the packing material 602 that covers the complementary article of footwear 1302. In aspects, a wrapping member 606 can radially move from a resting position over the complementary article of footwear 1304 draping at least a portion of the packing material 602 over at least a portion of the complementary article of footwear 1304.

In aspects, once the complementary articles of footwear 1302 and 1304 are at least partly covered in the packing material 602, thereby forming packing material-covered complementary articles of footwear 1302 and 1304, the packing material-covered complementary articles of footwear 1302 and 1304 can be transported to the transfer station 140, e.g., via the conveyance apparatus 502.

Figure 8:
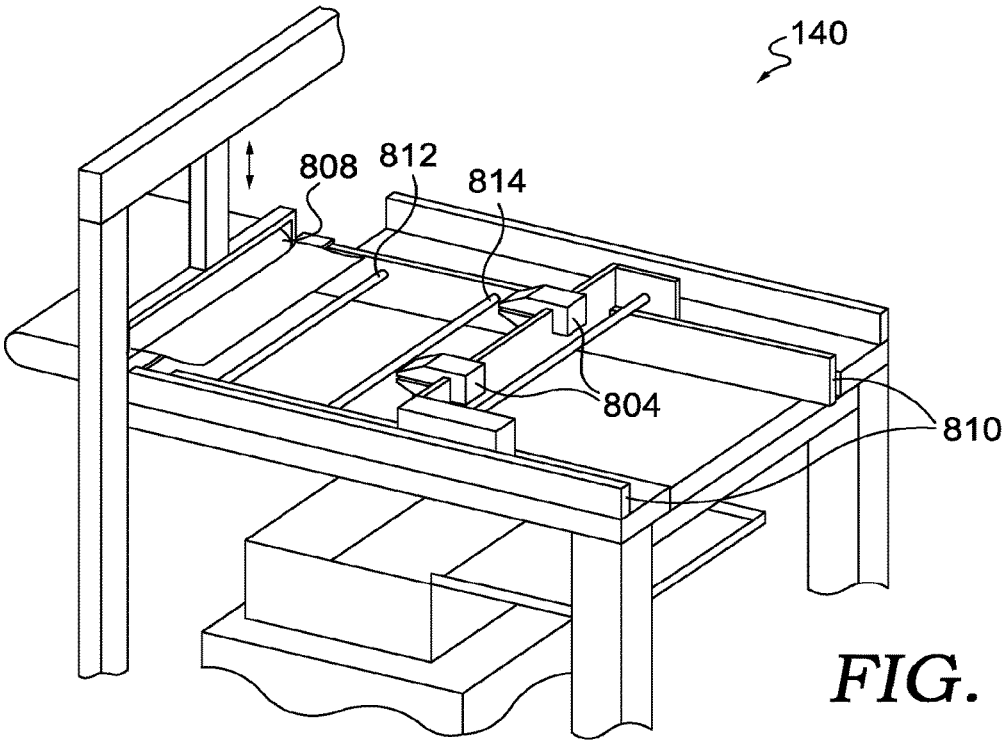
FIG. 8 is a top and side perspective view of a transfer station, in accordance with aspects hereof.
Figure 9A:
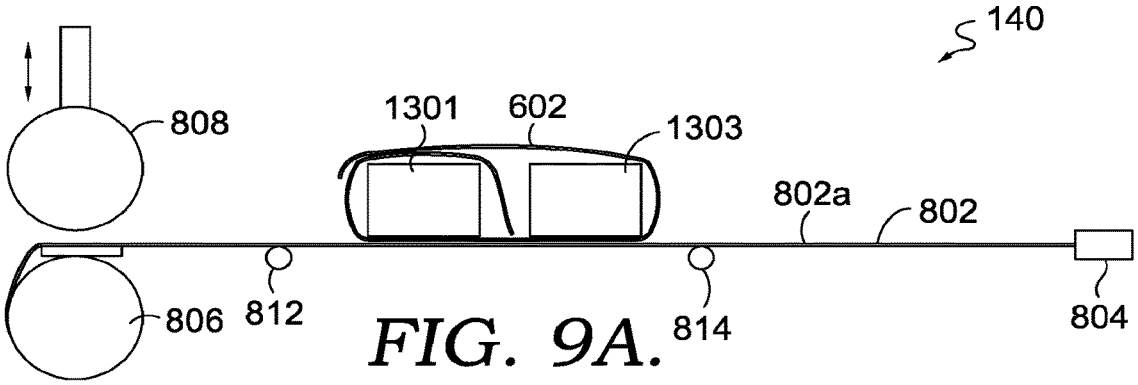
FIG. 9A is a schematic side view of a portion of a transfer station depicting complementary articles of footwear positioned on a top side of a reusable packing sheet, a packing sheet source, a pressing member, guiding members, and a sheet extension member, in accordance with aspects hereof.

FIG. 8 depicts one aspect of a transfer station 140 and FIG. 9A is a schematic of side view of a portion of the transfer station 140 to better depict certain aspects herein. In certain aspects, the transfer station 140 can include a reusable packing sheet 802 and sheet extension members 804. Further, as best seen in FIG. 9A, the transfer station can also include a packing sheet source 806. In certain aspects, the transfer station 140 can also include a compression member 808. It should be noted that FIG. 9A schematically depicts complementary articles of footwear 1301 and 1303, which can correspond to the complementary articles of footwear 1302 and 1304, respectively, discussed herein, but have been given different numbers to reflect the more schematic nature of their depictions.

In aspects, the reusable packing sheet 802 can include any pliable material that can efficiently be slid out from under the packing material-covered complementary articles of footwear 1302 and 1304 when present in a container, as discussed further below. In one aspect, the reusable packing sheet 802, or an outer surface of the reusable packing sheet 802 exhibits a static coefficient of friction against steel of less than about 0.4, or less than about 0.3, or from about 0.05 to about 0.2. In one or more aspects, the reusable packing sheet 802 can comprise polytetrafluoroethylene.

In certain aspects, the reusable packing sheet 802 can have a length that is at least about 45 centimeters (cm) or at least about 60 cm. In certain aspects, the reusable packing sheet 802 can have a width of at least about 15 cm, or at least about 20 cm. In one aspect, the reusable packing sheet 802 is sized so that complementary articles of footwear can be positioned on top of the reusable packing sheet 802 and not extend beyond the reusable packing sheet 802 more than 6 inches, more than 3 inches, or more than 2 inches.

As can be seen in FIG. 9A, the packing sheet source 806 can be a roll that includes at least a portion of the reusable packing sheet 802 rolled around the core of the roll. It should be understood that the packing sheet source 806 is exemplary and other configurations or types of packing sheet sources can be utilized in the present system. For instance, in one aspect, the packing sheet source can include a linearly extending portion of reusable packing sheet 802 that extends underneath the wrapping station 130, sizing station 120, and/or the alignment station 110.

In certain aspects, the sheet extension members 804 can contact the reusable packing sheet 802 and extend it out away from the packing sheet source 806 and past the guiding members 812 and 814. In such aspects, the sheet extension members 804 can be coupled to a movement mechanism that can shift the sheet extension members 804 from a position adjacent the packing sheet source 806 to a position distal to the packing sheet source 806, such as the position of the sheet extension members 804 depicted in FIG. 9A. In aspects, the sheet extension members 804 can move along one or more tracks 810, e.g., using any conventional movement mechanism.

In one or more aspects, as the reusable packing sheet 802 is extending out from the packing sheet source 806, the complementary articles of footwear 1301 and 1303 can also travel along with the reusable packing sheet 802 to a final position, such as a position between the guiding members 812 and 814. In such aspects, a mechanical or optical sensor may be used to communicate when the complementary articles of footwear 1301 and 1303 are being transported to the transfer station 140, e.g., via the conveyance apparatus 502 of the wrapping station 130, so that the reusable packing sheet 802 can begin to extend out and transport the complementary articles of footwear 1301 and 1303 with the reusable packing sheet 802 in sync. In alternative aspects, the complementary articles of footwear 1301 and 1303 may be transported, e.g., using a conventional alternative transport mechanism, to the reusable packing sheet 802 after having been extended out and forming a plane, as discussed below.

In certain aspects, the sheet extension members 804 can be configured in any manner as long as the sheet extension members 804 can contact the reusable packing sheet 802 and extend it out away from the packing sheet source 806 and past the guiding members 812 and 814. As can be seen in FIG. 9A, the sheet extension members 804 can maintain tension on the reusable packing sheet 802 sufficient to maintain at least a portion of, or the entirety of, the complementary articles of footwear 1301 and 1303 positioned above the guiding members 812 and 814. In such aspects, the compression member 808 can contact the reusable packing sheet 802 and apply a downward force on the reusable packing sheet 802 in combination with the forces applied by the sheet extension members 804 to maintain a sufficient tension on the reusable packing sheet 802 to maintain at least a portion of, or the entirety of, the complementary articles of footwear 1301 and 1303 positioned above the guiding members 812 and 814. In the same or alternative aspects, the packing sheet source 806 can apply a force to the reusable packing sheet 802 in combination with the forces applied by the sheet extension members 804 to maintain a sufficient tension on the reusable packing sheet 802 to maintain at least a portion of, or the entirety of, the complementary articles of footwear 1301 and 1303 positioned above the guiding members 812 and 814.

In one or more aspects, as can be seen in FIG. 9A, the sheet extension members 804 can maintain tension on the reusable packing sheet 802 so that the reusable packing sheet 802 forms, and maintains, a plane even when the complementary articles of footwear 1301 and 1303 are positioned on a top surface 802*a* of the reusable packing sheet 802. In such aspects, the compression member 808 can contact the reusable packing sheet 802 and apply a downward force on the reusable packing sheet 802 in combination with the forces applied by the sheet extension members 804 to form and maintain a plane of the reusable packing sheet 802 even when the complementary articles of footwear 1301 and 1303 are positioned on a top surface 802*a* of the reusable packing sheet 802. In the same or alternative aspects, the packing sheet source 806 can apply a force to the reusable packing sheet 802 in combination with the forces applied by the sheet extension members 804 to form and maintain a plane of the reusable packing sheet 802 even when the complementary articles of footwear 1301 and 1303 are positioned on a top surface 802*a* of the reusable packing sheet 802. In various aspects, the forces applied by the sheet extension members 804 (and/or by the compression member 808 and/or by the packing sheet source 806) to form the plane of the reusable packing sheet 802 can be sufficient to limit the vertical shift of a portion of the plane of the reusable packing sheet 802 downward less than about 25 centimeters, less than about 13 cm, or less than about 10 cm, when the complementary articles of footwear 1301 and 1303 are positioned on a top surface 802*a* of the reusable packing sheet 802. In one or more aspects, the plane of the reusable packing sheet 802 as described above can be formed in the absence of the guiding members 812 and 814.

Figure 9B:
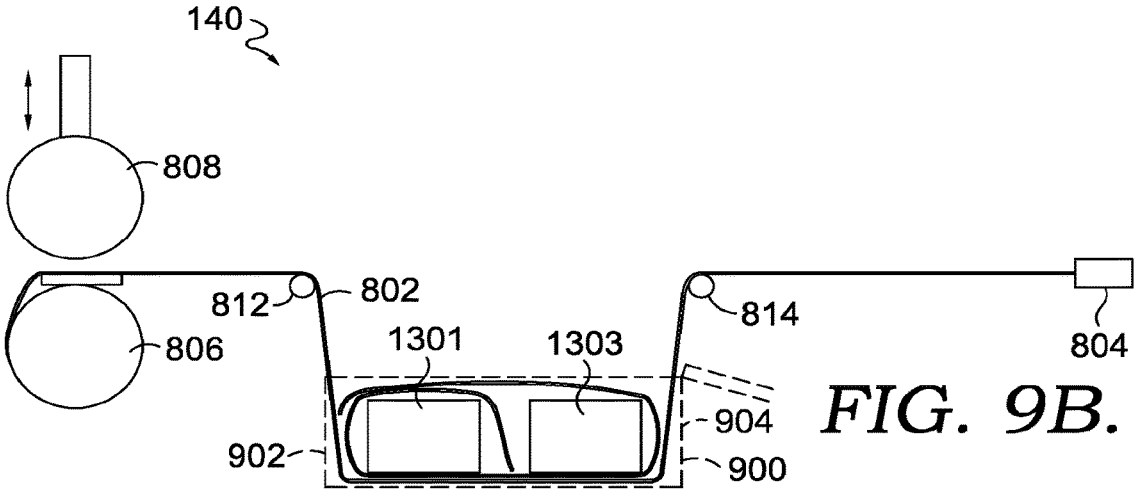
FIG. 9B is another schematic side view of a portion of the transfer station depicted in FIG. 9A, showing the complementary articles of footwear and the reusable packing sheet positioned inside a container, in accordance with aspects hereof.

FIG. 9B depicts a schematic representation of a transfer station 140 after the reusable packing sheet 802 has been lowered to transfer the complementary articles of footwear 1301 and 1303 into a container 900. As discussed above, by using a reusable packing sheet 802 the complementary articles of footwear 1301 and 1303 can be placed in a container 900 with minimal margins between the sides of the container 900, e.g., the sides 902 and 904, and the complementary articles of footwear 1301 and 1303. In such aspects, the packing of the complementary articles of footwear 1301 and 1303 in the container 900 with minimal margins can be achieved in a more efficient manner than can be accomplished manually, e.g., due to inefficiencies associated with the manual selection of packing materials and/or containers. Further, in such aspects, by using the reusable packing sheet 802 to lower the complementary articles of footwear 1301 and 1303 into the container 900 less damage to articles of footwear or containers occurs compared to the use of mechanical gripper or contacting components for manipulating articles of footwear into a container with minimal margins between the articles of footwear and the sides of the container.

In one aspect, the guiding members 812 and 814 can guide the complementary articles of footwear 1301 and 1303 down toward the container 900 in the appropriate direction so as to be placed correctly inside the container 900. In alternative aspects, the sides 902 and 904 of the container 900 can be utilized as guides to direct the complementary articles of footwear 1301 and 1303 into the proper position within the container 900, in the absence of the guiding members 812 and 814.

As can be seen in the aspect depicted in FIG. 9A, when the complementary articles of footwear are placed inside the container 900, the reusable packing sheet 802 is positioned inside the container 900 and underneath the complementary articles of footwear 1301 and 1303. In such aspects, the packing sheet source 806 can retract the reusable packing sheet 802 back towards the packing sheet source 806 so that the reusable packing sheet 802 is removed from the container 900. Further in such aspects, as discussed above, the reusable packing sheet 802 can include a material having a low static coefficient of friction so that the reusable packing sheet 802 can slide out of the container 900 without disturbing the position of the complementary articles of footwear 1301 and 1303 inside the container. In one or more aspects, during or before the reusable packing sheet 802 is retracted back towards the packing sheet source 806 the sheet extension members 804 can disengage from contacting the reusable packing sheet 802.

As discussed above, in certain aspects, when the complementary articles of footwear 1301 and 1303 are positioned on or transported to the reusable packing sheet 802, the tension in the reusable packing sheet 802 can form and maintain a plane, and/or maintain at least a portion of the complementary articles of footwear 1301 and 1303 positioned above the guiding members 812 and 814. In aspects, in order to lower the complementary articles of footwear into a container, e.g., the container 900, the above-described tension in the reusable packing sheet 802 can be reduced, thereby allowing the weight of the complementary articles of footwear 1301 and 1303 to move the reusable packing sheet 802 and the complementary articles of footwear 1301 and 1303 down and ultimately into a container.

Figure 10A:
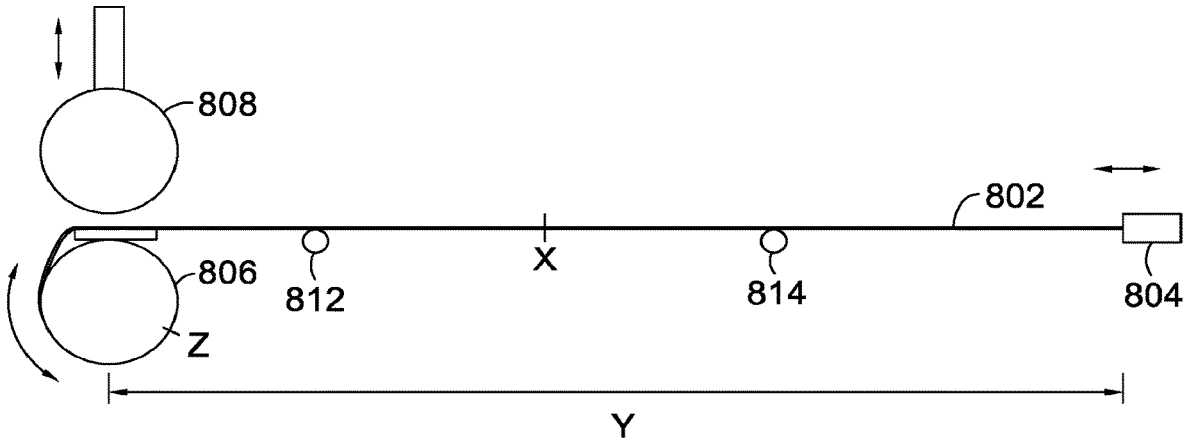
FIG. 10A is a schematic side view of a portion of a transfer station depicting a reusable packing sheet extended out with the sheet extension member positioned beyond the guiding members, in accordance with aspects hereof.
Figure 10B:
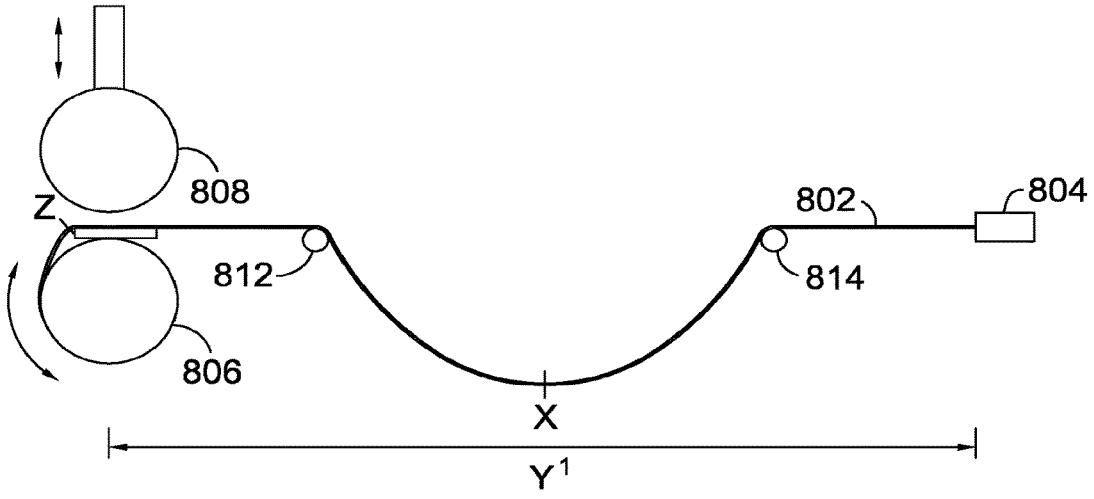
FIG. 10B is a schematic side view of the portion of the transfer station of FIG. 10A showing the sheet extension member having moved back towards the packing sheet source and the packing sheet having released an additional portion of the reusable packing sheet, and the reusable packing sheet dropping below the guiding members, in accordance with aspects hereof.

FIGS. 10A and 10B depict one aspect of reducing tension in the reusable packing sheet 802 to lower the complementary articles of footwear into a container. FIG. 10A is a schematic depiction of the reusable packing sheet 802 forming a plane, where at least the portion of the reusable packing sheet 802 positioned between the guiding members 812 and 814 is positioned above the guiding members 812 and 814. Further in this aspect depicted in FIG. 10A, the sheet extension members 804 are positioned at a distal point that is a distance Y from the center of the packing sheet source 806.

In the aspect depicted in FIG. 10B, the reusable packing sheet 802 is lowered by the movement of the sheet extension members 804 toward the packing sheet source 806 so that the sheet extension members 804 are position at a distance Y 1 from the center of the packing sheet source 806. Further, an additional portion of the reusable packing sheet 802 extends out from the packing sheet source 806 thereby increasing the absolute length of the reusable packing sheet 802 extending out from the packing sheet source 806. For example, as can be seen in FIGS. 10A and 10B, the radial movement of the packing sheet source 806 can extend out an additional portion of the reusable packing sheet 802, as depicted by comparing the position Z on the reusable packing sheet 802 from FIGS. 10A and 10B.

In certain aspects, the additional portion of the reusable packing sheet 802 can be extending in sync with the movement of the sheet extension members 804 so that the reusable packing sheet 802 does not laterally move or does not substantially laterally move (e.g., less than about 20 cm, or less than about 5 cm) when being lowered down into a container. For example, as can be seen in FIGS. 10A and 10B, the position X on the reusable packing sheet 802 does not laterally move between the configurations depicted in FIGS. 10A and 10B. In such aspects, to cooperatively lower the reusable packing sheet 802 without lateral movement, the packing sheet source 806 and the sheet extension members 804, or associated mechanisms, can be in communication, e.g., using conventional systems known to one skilled in the art, and/or can include movement sensors.

In one or more aspects, the compression member 808 can be utilized to control the speed or amount of the additional portion of the reusable packing sheet 802 that is extended out from the packing sheet source 806, e.g., by applying or releasing a force on the reusable packing sheet 802.

Figure 11A:
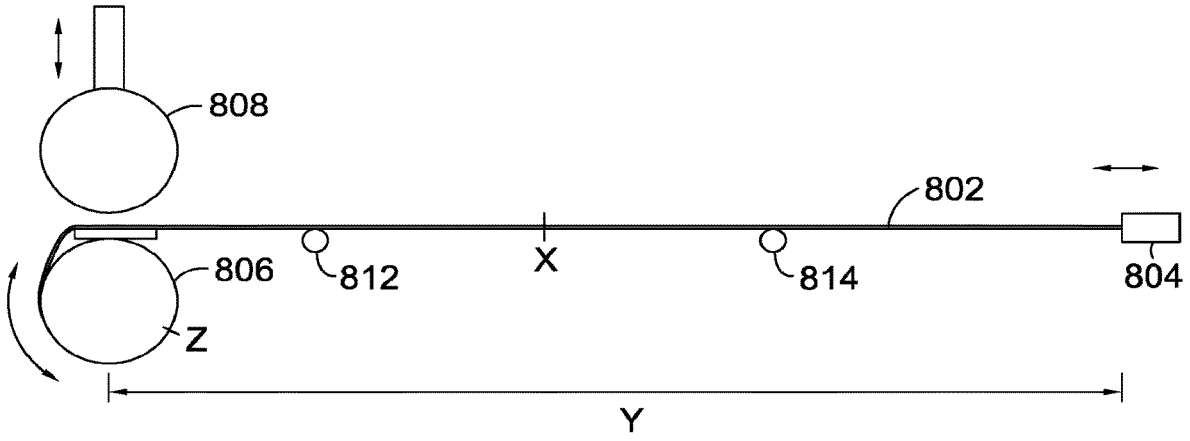
FIG. 11A is a schematic side view of a portion of a transfer station depicting a reusable packing sheet extended out with the sheet extension member positioned beyond the guiding members, in accordance with aspects hereof.
Figure 11B:
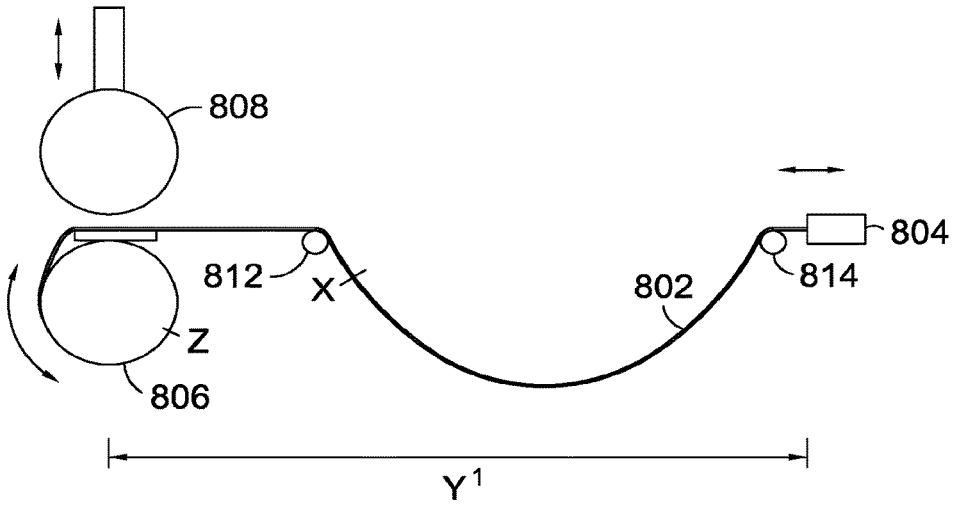
FIG. 11B is a schematic side view of the portion of the transfer station of FIG. 11A depicting the sheet extension member having moved back towards the packing sheet source, and the pressing member contacting the reusable packing sheet, and the reusable packing sheet dropping below the guiding members in accordance with aspects hereof.

FIGS. 11A and 11B depict an alternative aspect for reducing the tension in the reusable packing sheet 802 for lowering the reusable packing sheet 802 (and complementary articles of footwear) into a container. At a high level, in the aspect depicted in FIGS. 11A and 11B, the tension in the reusable packing sheet 802 is reduced by the movement of the sheet extension members 804, while the absolute length of the reusable packing sheet 802 extended out from the packing sheet source 806 is the same or substantially the same (e.g., less than about a 15 cm difference in length or less than about a 5 cm difference in length).

As can be seen in FIG. 11A, the reusable packing sheet 802 forms a plane, where at least the portion of the reusable packing sheet 802 positioned between the guiding members 812 and 814 is positioned above the guiding members 812 and 814. Further in this aspect depicted in FIG. 10A, the sheet extension members 804 are positioned at a distal point that is a distance Y from the center of the packing sheet source 806.

In FIG. 11B, the sheet extension members 804 have laterally moved towards the packing sheet source 806 to a be a distance Y 1 from the center of the packing sheet source 806. In such aspects, no additional portion of the reusable packing sheet 802 is extended out from the packing sheet source 806 (as depicted by the same Z position of the reusable packing sheet 802 in FIGS. 11A and 11B), so a portion of the reusable packing sheet 802 may laterally shift, as depicted by the movement of the X position on the reusable packing sheet 802 between FIGS. 11A and 11B. In such aspects, the compression member 808 and/or the packing sheet source 806 can provide a force to resist the extension of an additional portion of the reusable packing sheet 802 from extending out, or to resist the retraction of a portion of the reusable packing sheet 802, as the sheet extension members 804 laterally move towards the packing sheet source 806.

As discussed above, in the aspect depicted in FIGS. 11A and 11B, as the sheet extension members 804 moves back towards the packing sheet source 806, reducing tension in the reusable packing sheet 802 and lowering it, the reusable packing sheet 802 can laterally move back towards the packing sheet source 806. In such aspects, even if the reusable packing sheet 802 laterally moves, a reusable packing sheet 802 having an outer surface with a reduced static coefficient of friction can facilitate or enhance any sliding of the complementary articles of footwear within the concave portion of the reusable packing sheet 802 (as depicted in FIG. 11B) so that the complementary articles of footwear can remain centered at the apex of the concave portion as they are lowered into a container.

Figure 12:
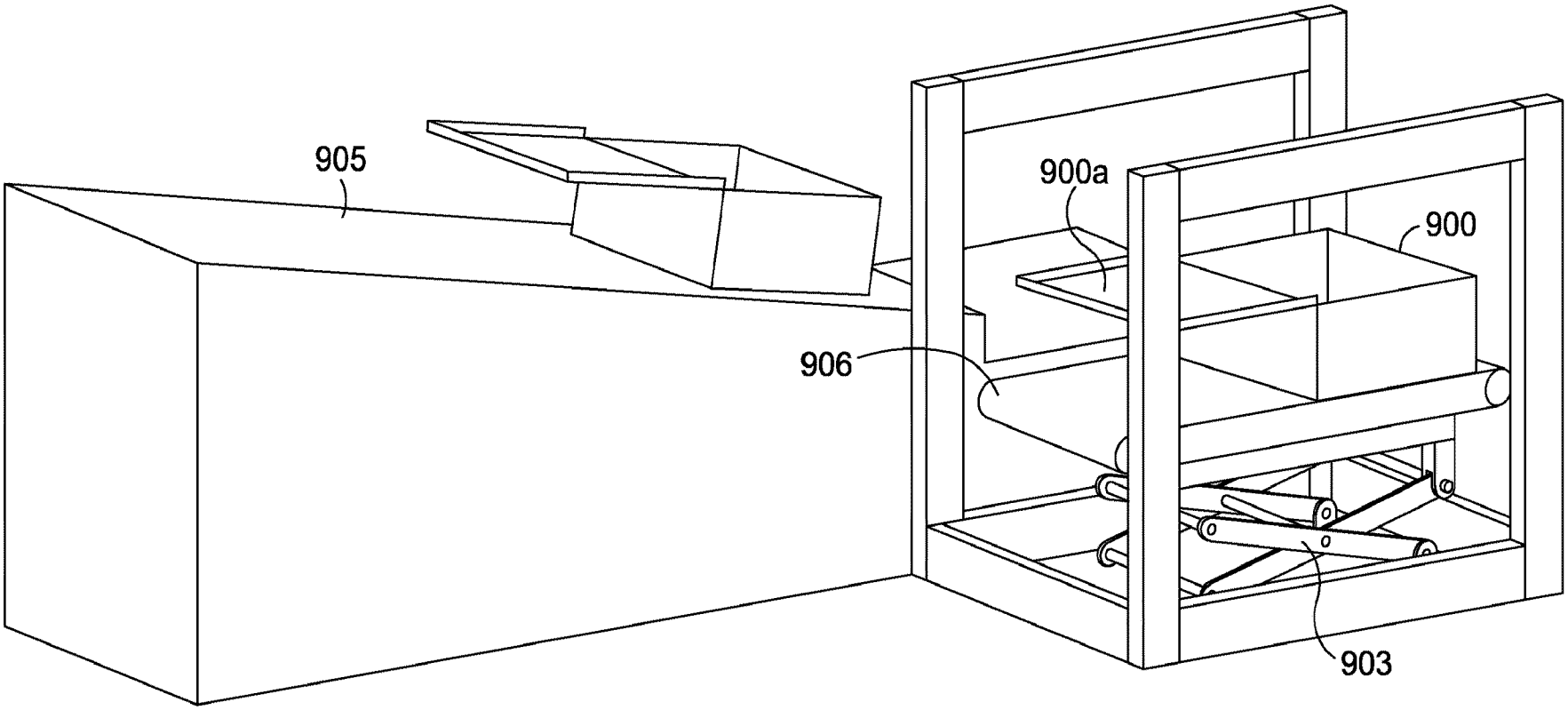
FIG. 12 is a top and side perspective view of a container conveyance system, in accordance with aspects hereof.

FIG. 12 depicts one aspect of a container conveyance system 150. In the aspect depicted in FIG. 12, a lift mechanism, e.g., the scissor lift 903 depicted in FIG. 12, can be utilized to raise and lower a container, e.g., the container 900. For example, in certain aspects, the container 900 may be raised to receive the complementary articles of footwear at a transfer station (not depicted in FIG. 12). In such aspects, after the container 900 has received the complementary articles of footwear and is lowered, or as the container is transferred away, e.g., on the conveyance apparatus 906, the container may be positioned such that an outer portion of the container lid 900*a* may contact a structure so that the container lid 900*a* closes.

FIG. 12 also depicts a container delivery mechanism 905 to deliver one or more containers for receiving complementary articles of footwear. The container delivery mechanism 905 can be any suitable delivery mechanism or conveyance mechanism and a particular mechanism or configuration can be chosen by one skilled in the art for a specific purpose.

Figure 14:
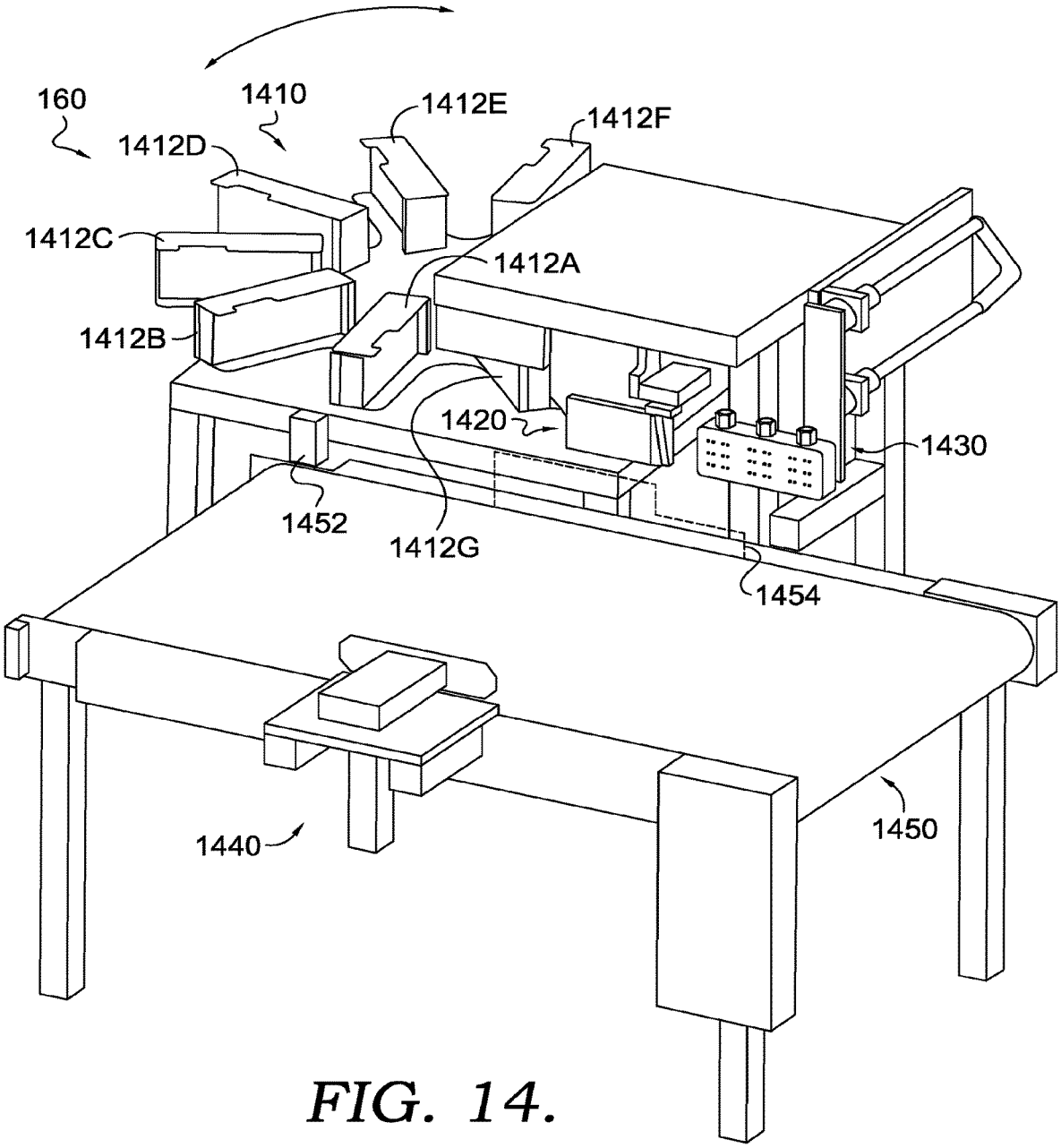
FIG. 14 is a top and side perspective view of an exemplary container labeling system including a label source, a label backing removal component, a label applicator, a container securing component, and a conveyance system, in accordance with aspects hereof.

FIG. 14 depicts one aspect of a container labeling system 160. In certain aspects, the container labeling system 160 selects and applies a label to a container received from the transfer station 140. It should be understood that the container labeling system 160 can be a stand-alone system and can be physically separated from the transfer station 140 or other components of the system 100 discussed above.

In one or more aspects, the container labeling system 160 can include a label source 1410, a label backing removal component 1420, a label applicator 1430, a container securing component 1440, and a conveyance apparatus 1450. It should be understood that the container labeling system 160 depicted in FIG. 14 is an exemplary aspect of one container labeling system and other types of components or arrangement of system components can be utilized herein.

In aspects, at a high level, the container labeling system 160 applies a container label to a container housing complementary articles of footwear, e.g., that were placed therein at the transfer station 140 of the system 100 of FIG. 1. In such aspects, the container housing the complementary articles of footwear can be transferred to the container labeling system 160 via the conveyance apparatus 906 discussed above with respect to the container conveyance system 150 depicted in FIG. 12.

In certain aspects, as a container is transferred to the conveyance apparatus 1450, the presence and location of the container can be sensed by a sensor, e.g., the sensor 1452 that can be coupled to the conveyance apparatus 1450. In such aspects, the sensor 1452 can be any type of commercially available sensor that is capable of detecting the presence and location of a container, such as a motion sensor or an optical sensor. Further in such aspects, the sensor 1452 can be communicatively coupled to a motor or other portion of the conveyance apparatus 1450 so that the conveyance apparatus 1450 can transfer the container to the appropriate location for the placement of the label to the container.

As discussed above, in certain aspects, the container labeling system 160 includes a label source, such as the label source 1410. As can be seen in the aspect depicted in FIG. 14, the label source 1410 can include a plurality of label containers, e.g., the label containers 1412A-1412G for housing a plurality of labels. The plurality of labels can include a plurality of differently marked labels for different types or sizes of articles of footwear. In aspects, each type of label can be stored in an individual label container, e.g., one of the label containers 1412A-1412G.

In aspects, when a particular label is needed for application to a container the label containers 1412A-1412G can rotate so that one of the label containers 1412A-1412G can engage or be adjacent to the label backing removal component 1420. FIG. 14 depicts the label container 1412G being positioned adjacent the label backing removal component 1420.

In certain aspects, the container labeling system 160 can be communicatively coupled to a sensor or identification component in order to identify which particular label is needed, such as the sensor 1452, or some other sensing or identification component associated with the alignment station 110, the sizing station 120 or the wrapping station 130 depicted in FIG. 1. In such an aspect, the need for a particular label can be communicated to the label source 1410 and cause the label containers 1412A-1412G to rotate until the appropriate label container housing the required label is positioned adjacent the label backing removal component 1420.

In one aspect, the label source 1410 can include a plurality of the same labels, in which case, communication of a required label may not be necessary, and instead, the label containers 1412A-1412G may rotate to maintain a steady supply of container labels adjacent the label backing removal component 1420.

It should be understood that the label source 1410 depicted in FIG. 14 is one exemplary label source and that other types of label sources are also contemplated for use in the system described herein. For example, in one or more aspects, the label source can include a printer for printing a particular label on demand. In such aspects, not depicted in the figures, a printer can be communicatively coupled to a sensor or identification component in order to identify which particular label should be printed, such as the sensor 1452, or some other sensing or identification component associated with the alignment station 110, the sizing station 120 or the wrapping station 130 depicted in FIG. 1.

As discussed above, in aspects, a particular label container, e.g., the label container 1412G, is positioned adjacent the label backing removal component 1420. In certain aspects, not depicted in the figures, a component of the label source 1410 can transfer a single label to the label backing removal component 1420 using conventional equipment, such as a moveable vacuum or suction device that can temporarily adhere one label thereto and transfer the label to the label backing removal component 1420.

Figure 15:
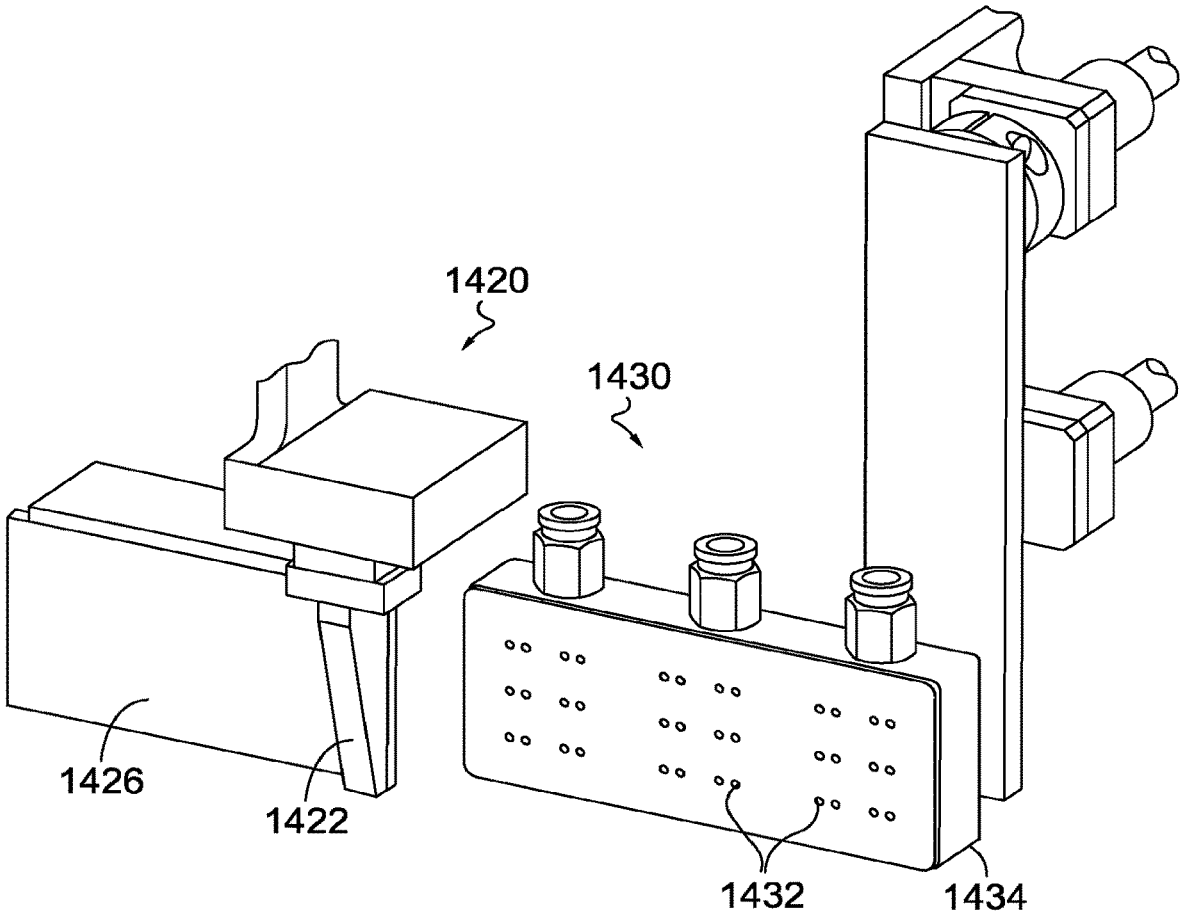
FIG. 15 is a top and perspective view of a portion of the label backing removal component and the label applicator of FIG. 14, in accordance with aspects hereof.
Figure 16:
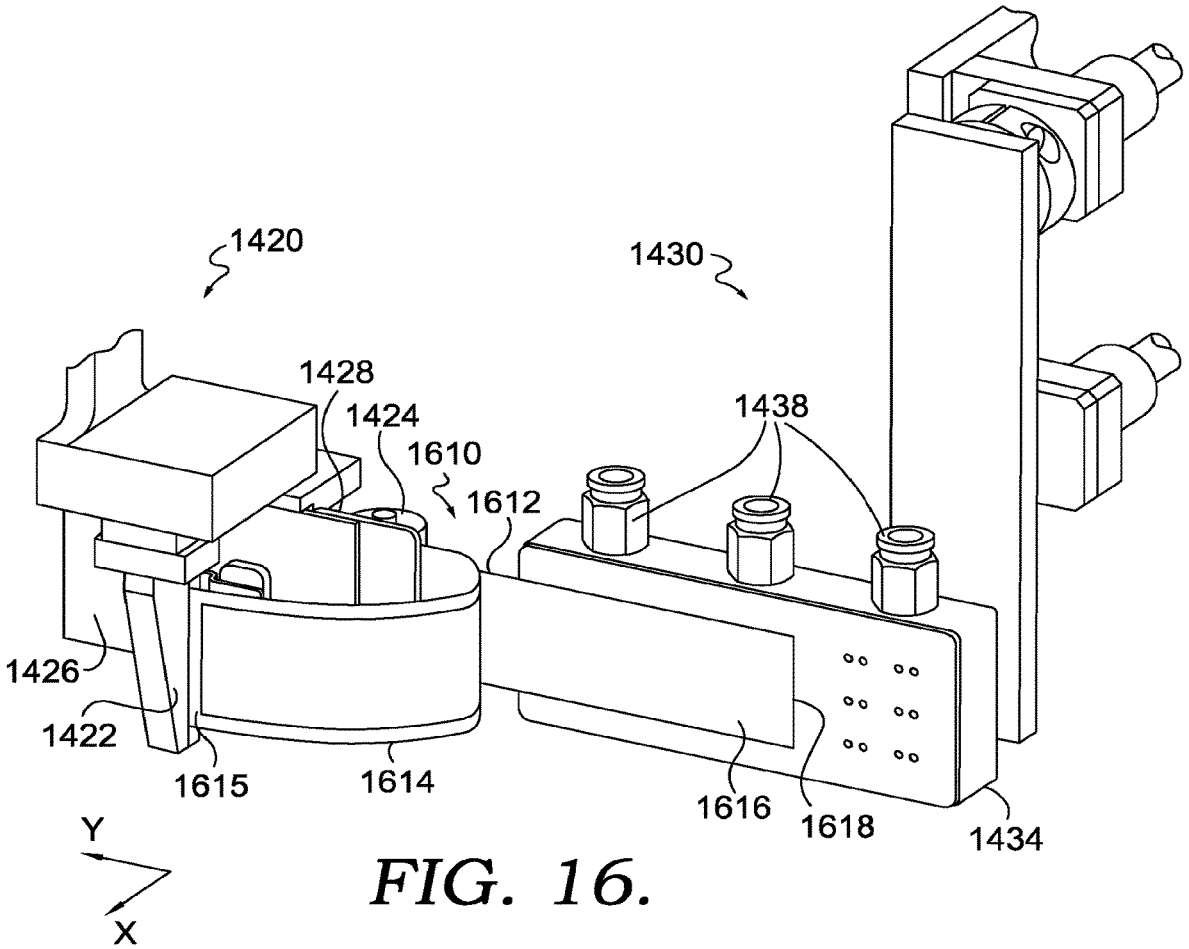
FIG. 16 is a top and perspective view of the label backing removal component and the label applicator of FIG. 15 showing the backing removal component removing the backing off a label while the label is transferred to the label applicator, in accordance with aspects hereof.

As can best be seen in FIGS. 15 and 16, the label backing removal component 1420 can include a backing engagement member 1422 and a label receiving member 1426. In operation, in various aspects, when a label is transferred from the label source 1410 to the label backing removal component 1420, the label can be positioned between a back side 1428 of the label receiving member 1426 and the roller 1424.

As can be seen in FIGS. 15 and 16, and discussed in further detail below, once a label 1610 is received at the label backing removal component 1420 the label 1610 can be transferred to the label applicator 1430 while the label backing 1614 is removed from the label 1610. For example, in certain aspects, one or more rollers, e.g., the roller 1424, can transfer the label 1610 from the label receiving member 1426 to the label applicator 1430 as the backing engagement member 1422 engages a portion of the backing for removal from the label 1610.

In certain aspects, once the backing engagement member 1422 engages a portion of the back of the label 1610, the backing engagement member 1422 can shift relative to the label receiving member 1426 in order to facilitate the removal of the backing. FIG. 15 depicts the backing engagement member 1422 in a first position where the backing engagement member 1422 initially engages a portion of the backing of the label 1610. FIG. 16 depicts the backing engagement member 1422 in a second position, where the backing engagement member 1422 has shifted out away from the label receiving member 1426 (e.g., the X direction depicted in FIG. 16) and laterally away from the label applicator 1430 (e.g., the Y direction depicted in FIG. 16). In such aspects, the backing engagement member 1422 can engage an edge portion 1615 of the label 1610, which does not form part of the unbacked label 1612, and then shift from the first position depicted in FIG. 15 to the second position depicted in FIG. 16. Further, in such aspects, while the backing engagement member 1422 is removing the label backing 1614, one or more rollers, e.g., the roller 1424, can continue to transfer the label towards the label applicator 1430.

In certain aspects, as can be seen in FIGS. 15 and 16, the label applicator 1430 includes a label engagement member 1434 for receiving the unbacked label 1612. In such aspects, the unbacked label 1612 is positioned on the label engagement member 1434 so that the adhesive face 1616 of the unbacked label 1612 is facing away from the label engagement member 1434. In certain aspects, such as that depicted in FIGS. 15 and 16, the label engagement member 1434 includes a plurality of apertures, e.g., the apertures 1432, to provide a negative or vacuum pressure such that the unbacked label 1612 is temporarily adhered to the label engagement member 1434. In certain aspects, the negative or vacuum pressure can be applied through the apertures 1432 via a vacuum or negative pressure generation device, not depicted in the figures that are in fluid communication with the apertures 1432, e.g., via one or more vacuum or negative pressure generation device connection members 1438.

Figure 17:
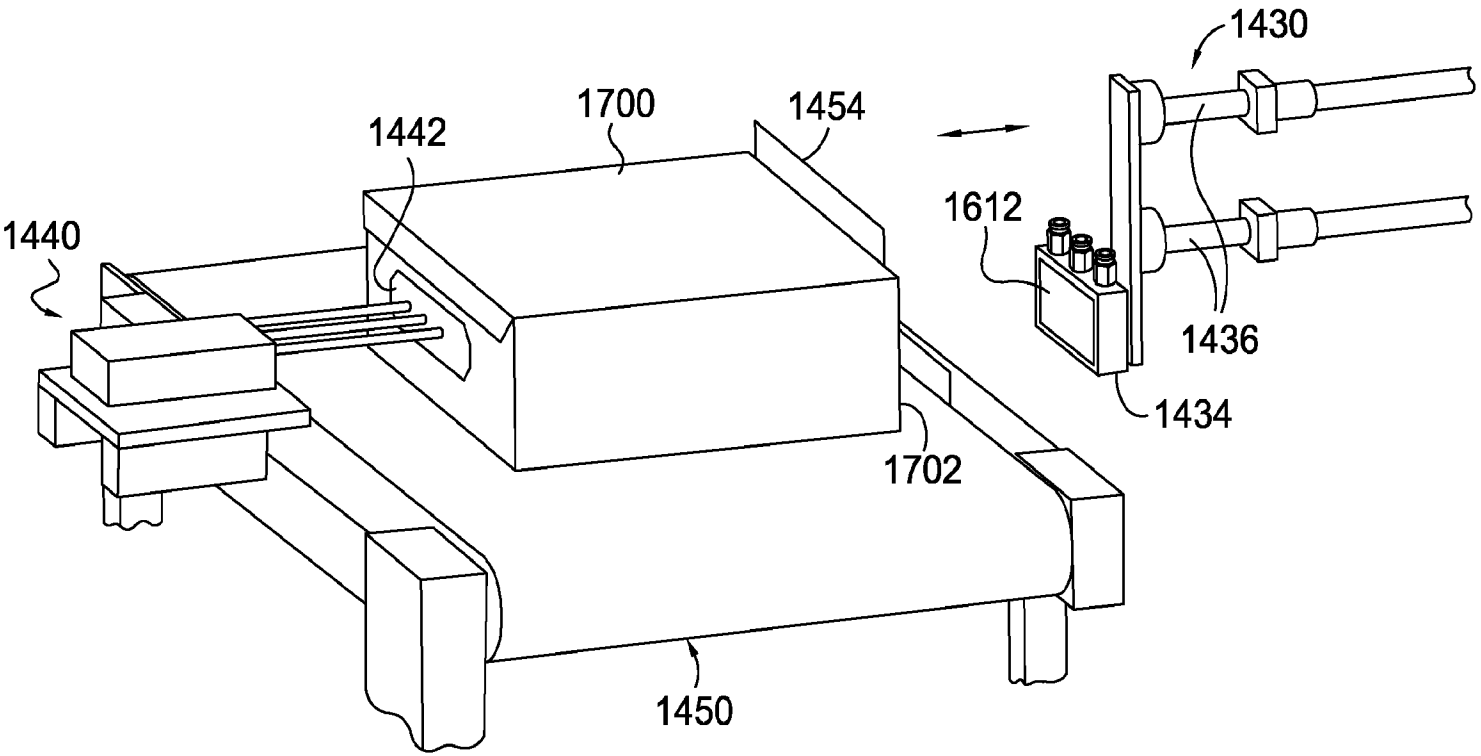
FIG. 17 is a top and perspective view of a portion of the exemplary container labeling system of FIG. 14 showing the label applicator moving towards a side of a container to apply a label thereto while the container securing component has extended to engage and secure the container on an opposing side of the container.

In certain aspects, once the unbacked label 1612 is temporarily adhered to the label engagement member 1434, the label applicator 1430 can apply the label to a container housing complementary articles of footwear. FIG. 17 depicts a container 1700 housing complementary articles of footwear positioned on the conveyance apparatus 1450 for application of the unbacked label 1612 via the label applicator 1430.

As can be seen in FIG. 17, the label applicator 1430 and the container securing component 1440 are positioned on opposing sides of the container 1700 and on opposing sides of a belt of the conveyance apparatus 1450. In certain aspects, once the container 1700 is positioned on the conveyance apparatus 1450 for application of the unbacked label 1612, a container contacting member 1442 of the container securing component 1440 can extend out contacting the container 1700 in order to move and position a side 1702 of the container 1700 in contact with a container positioning member 1454. In such aspects, once the side 1702 of the container 1700 is correctly positioned, e.g., by contacting the container positioning member 1454, the label applicator 1430 can extend towards the container 1700 and apply the unbacked label 1612 to the side 1702 of the container 1700. In one or more aspects, extension members 1436 can extend outward causing the label engagement member 1434, temporarily adhering the unbacked label 1612 thereto, to extend towards the container 1700.

In certain aspects, once the unbacked label 1612 has been applied, e.g., via the adhesive on the adhesive face 1616 of the unbacked label 1612, the container contacting member 1442 can extend back away from the container 1700 and the conveyance apparatus 1450 can transfer the container 1700 for further processing.

Figure 18:
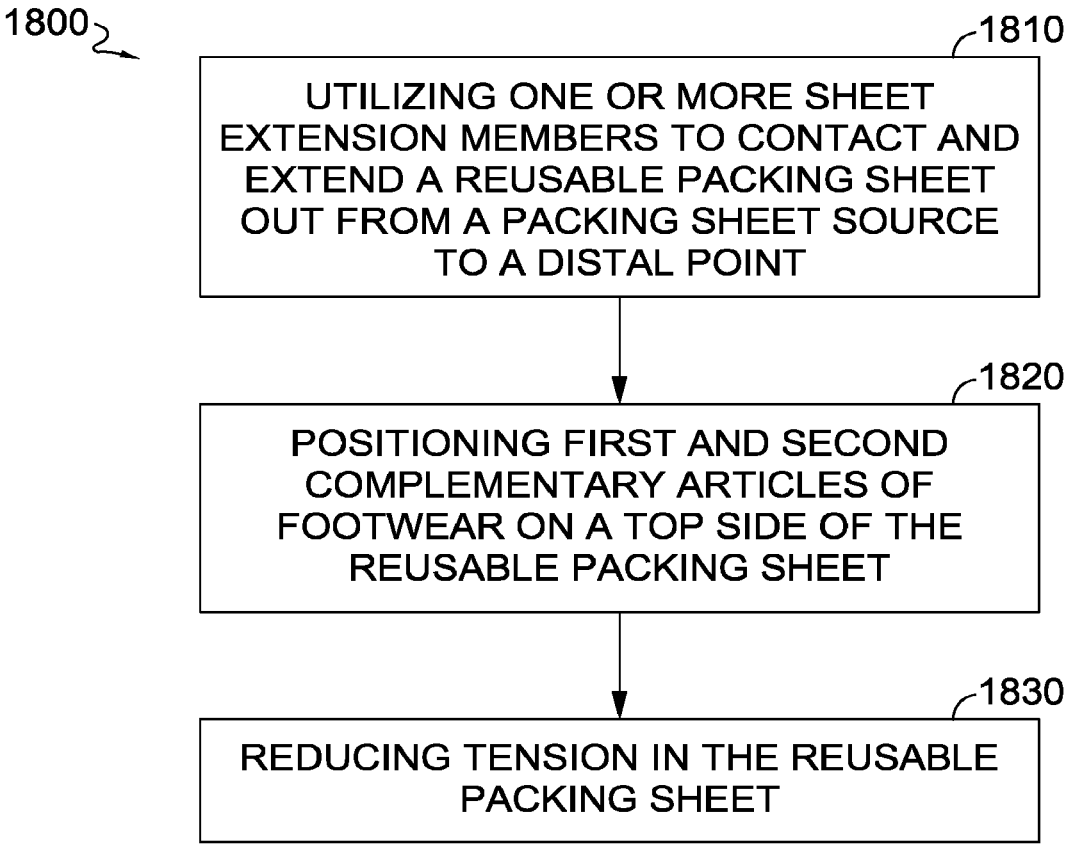
FIG. 18 is a flow diagram of a method of packing complementary articles of footwear into a container, in accordance with aspects hereof.

Turning now to FIG. 18, which depicts a flow diagram of a method 1800 of packing complementary articles of footwear into a container. At step 1810, the method 1800 includes utilizing one or more sheet extension members to contact and extend a reusable packing sheet out from a packing sheet source to a distal point. In aspects, the sheet extension members 804 discussed above with reference to FIGS. 8-11B can be used for contacting and extending the reusable packing sheet out from the packing sheet source. In certain aspects, the reusable packing sheet can include any or all of the properties and parameters of the reusable packing sheet 802 described above with reference to FIGS. 8-11B. Further, as can be seen in the aspects depicted in FIGS. 9A, 10A, and 11A, a reusable packing sheet can extend from the packing sheet source past the guiding members 812 and 814 to a point distal to the packing sheet source 806. Further, as can be seen in the aspects depicted in FIGS. 9A, 10A, and 11A, a bottom side of the reusable packing sheet 802 can face the guiding members 812 and 814.

At step 1820, the method 1800 also includes positioning first and second complementary articles of footwear on a top side of the reusable packing sheet at a position between the first and second guiding members while tension in the reusable packing sheet at least between the first and second guiding members is sufficient to maintain at least a portion of the first and second complementary articles of footwear positioned above the first and second guiding members. In aspects, the components and respective properties associated with the transfer station 140 discussed above with reference to FIG. 9A can be utilized to achieve the features of step 1820. For example, as discussed above with reference to FIG. 9A, as the reusable packing sheet 802 extends out away from the packing sheet source 806, the complementary articles of footwear can travel along with the reusable packing sheet 802 to the position between the guiding members 812 and 814. Further, in such aspects, as discussed above with reference to FIG. 9A, one or more of the forces provided by the sheet extension members 804, the compression member 808, the packing sheet source 806, or a combination thereof, may be used to create the tension in the reusable packing sheet 802 at least between the guiding members 812 and 814 that is sufficient to maintain at least a portion of the complementary articles of footwear positioned above the guiding members 812 and 814.

At step 1830, the method 1800 includes, subsequent to the positioning the first and second complementary articles of footwear on the top side of the reusable packing sheet, reducing tension in the reusable packing sheet so that the first and second complementary articles of footwear vertically shift below the first and second guiding members and into a container. In aspects, the tension in the reusable packing sheet can be reduced using any or all of the processes and components (and their respective properties) discussed above with reference to FIGS. 10A-11B. For example, in aspects, the lateral movement of the sheet extension members 804 towards the packing sheet source 806 alone, or in combination with an additional portion of the reusable packing sheet 802 being extended out from the packing sheet source 806, may reduce the tension in the reusable packing sheet 802 so that the complementary articles of footwear can vertically shift into a container.

Figure 19:
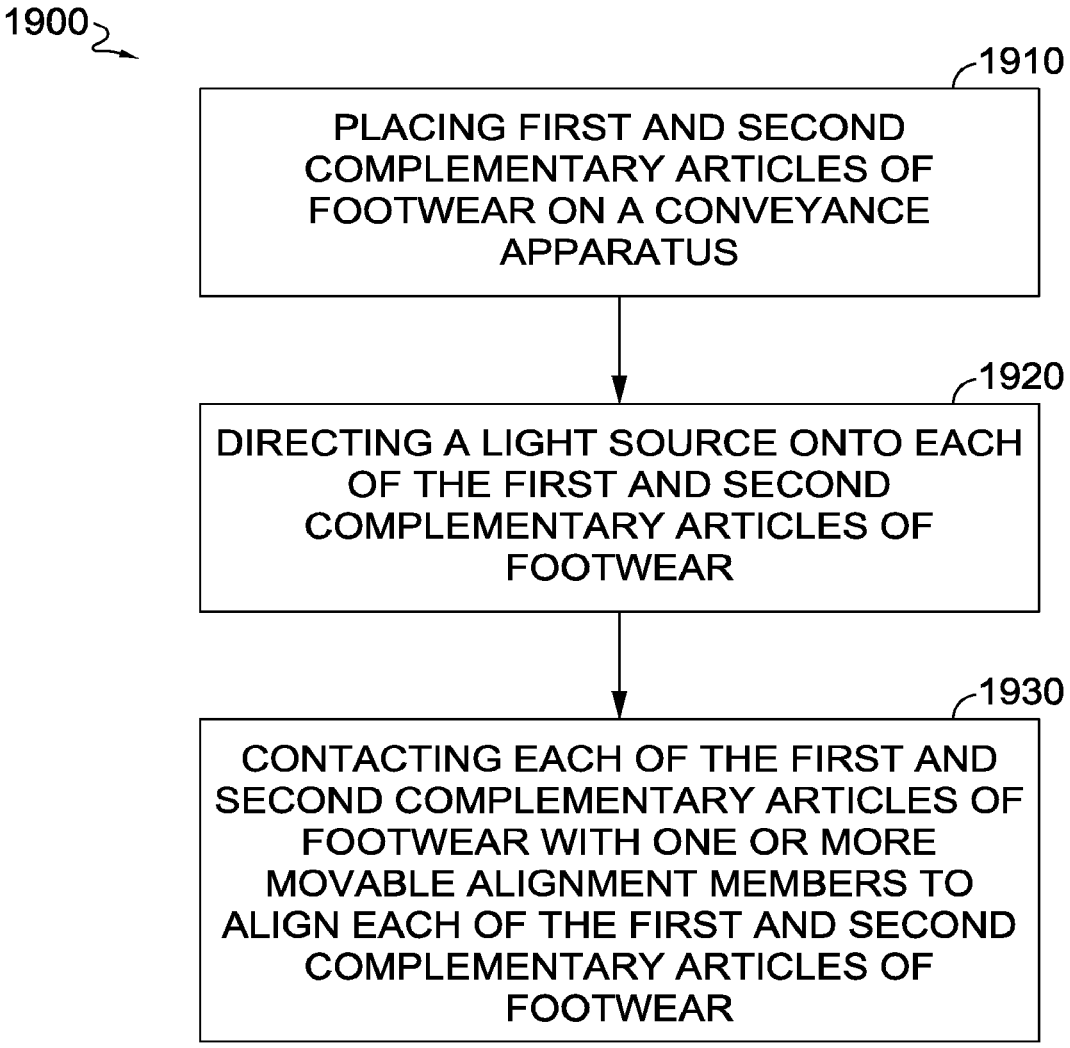
FIG. 19 is a flow diagram of a method of aligning complementary articles of footwear for packing, in accordance with aspects hereof.

FIG. 19 depicts a flow diagram of a method 1900 of aligning complementary articles of footwear for packing. The method 1900 includes a step 1910 of placing first and second complementary articles of footwear on a conveyance apparatus so that an outsole of each of the first and second complementary articles of footwear contacts the conveyance apparatus. In certain aspects, the complementary articles of footwear can be placed on the conveyance apparatus 202 of the alignment station 110 as depicted in FIG. 2. In such aspects, the complementary articles of footwear can be arranged in a heel to toe manner as depicted in FIG. 2.

The method 1900 also includes a step 1920 of directing a light source onto each of the first and second complementary articles of footwear to identify the desired location of an apex position of a toe end or a heel end of each of the first and second complementary articles of footwear on the conveyance apparatus. In aspects, the light sources 206 and 207 described above with reference to FIG. 2 can be utilized to direct a light source onto each of the complementary articles of footwear to achieve the desired positioning of the complementary articles of footwear featured in step 1920.

At step 1930 of the method 1900, each of the first and second complementary articles of footwear are contacted with one or more moveable alignment members to align each of the first and second complementary articles of footwear so that an axis extending from the toe end to the heel end of the first complementary article of footwear is substantially parallel to an axis extending from the toe end to the heel end of the second complementary article of footwear. In certain aspects, the moveable alignment members 208 and 209 discussed above with reference to FIG. 2 can be utilized to align the complementary articles of footwear in the manner described in step 1930.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

While specific elements and steps are discussed in connection to one another, it is understood that any element and/or steps provided herein is contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

The invention claimed is:

1. A system for packing complementary articles of footwear into a container, the system comprising:

a conveyance apparatus sized to transport a first complementary article of footwear and a second complementary article of footwear;

one or more moveable alignment members, each of the one or more moveable alignment members having a first contacting component and a second contacting component positioned on opposing sides of the conveyance apparatus, wherein the first contacting component and the second contacting component are moveable towards or away from one another, for contacting or releasing from contact one of the first complementary article of footwear and the second complementary article of footwear;

a first transfer member and a second transfer member that are vertically and laterally shiftable, wherein each of the first transfer member and the second transfer member comprise a first contacting component and a second contacting component that are rotatable about an axis that is transverse to a lateral movement direction of the first transfer member and the second transfer member;

a packing sheet source comprising a reusable packing sheet;

a first guiding member and a second guiding member laterally spaced apart from the packing sheet source at fixed positions so that the first guiding member is positioned between the packing sheet source and the second guiding member; and one or more sheet extension members, the one or more sheet extension members shiftable from a first position where the one or more extension members are positioned between the packing sheet source and the first guiding member to a second position where the first guiding member and second guiding member are positioned between the packing sheet source and the one or more sheet extension members.

2. The system of claim 1, further comprising a plurality of packing material sources, wherein each of the plurality of packing material sources comprises packing material sized for different sizes of articles of footwear.

3. The system of claim 1, further comprising a light source positioned to direct light in a direction transverse to the direction of extension of the conveyance apparatus, the light source adapted to identify the desired location of the apex position of a toe end or a heel end of the first complementary article of footwear when the outsole of the first article of footwear contacts the conveyance apparatus.

4. The system of claim 3, wherein the light source is coupled to the one or more moveable alignment members.

5. The system of claim 1, further comprising a container labeling system, the container labeling system comprising a label source configured to house a plurality of labels.

6. The system of claim 5, further comprising a label backing removal component, wherein the label backing removal component comprises a label receiving member and a backing engagement member that is shiftable relative to the label receiving member.

7. The system of claim 6, further comprising a label applicator, wherein the label applicator comprises a label engagement member in fluid communication with a negative pressure generation source.

8. The system of claim 1, wherein the conveyance apparatus is a belt.

9. The system of claim 1, wherein the first contacting component comprises a concave shape configured to receive a portion of a toe end or a heel end.

10. The system of claim 1, wherein the packing sheet source comprises a roll that includes at least a portion of the reusable packing sheet and extends underneath one or more of a wrapping station, a sizing station, and an alignment station.

11. A system for packing complementary articles of footwear into a container, the system comprising:

a conveyance apparatus sized to transport a first complementary article of footwear and a second complementary article of footwear;

one or more moveable alignment members, each of the one or more moveable alignment members having a first contacting component and a second contacting component positioned on opposing sides of the conveyance apparatus, wherein the first contacting component and the second contacting component are moveable towards or away from one another, for contacting or releasing from contact one of the first complementary article of footwear and the second complementary article of footwear;

a light source, the light source configured to direct light in a direction transverse to a direction of extension of the conveyance apparatus, the light is useable to identify a desired location of an apex position of a toe end or a heel end of each of the first complementary article of footwear and the second complementary article of footwear when an outsole of each of the first complementary article of footwear and the second complementary article of footwear contact the conveyance apparatus; and a first transfer member and a second transfer member that are vertically and laterally shiftable, wherein each of the first transfer member and the second transfer member comprise a first contacting component and a second contacting component that are rotatable about an axis that is transverse to a lateral movement direction of the first transfer member and second transfer member.

12. The system of claim 11, further comprising an alignment station, wherein the alignment station determines that the first complementary article of footwear and second complementary article of footwear are in alignment with respect to each other and the system components.

13. The system of claim 11, further comprising a sizing station, wherein the sizing station determines the size of the first complementary article of footwear and second complementary article of footwear.

14. A system for packing complementary articles of footwear into a container, the system comprising:

a packing sheet source capable of maintaining a reusable packing sheet;

a first guiding member and a second guiding member laterally spaced apart from the packing sheet source at fixed positions so that the first guiding member is positioned between the packing sheet source and the second guiding member; and one or more sheet extension members, the one or more sheet extension members shiftable from a first position where the one or more extension members are positioned between the packing sheet source and the first guiding member to a second position where the first guiding member and second guiding member are positioned between the packing sheet source and the one or more sheet extension members.

15. The system of claim 14, further comprising a plurality of packing material sources, wherein each of the plurality of packing material sources is configured to comprise packing material sized for different sizes of articles of footwear.

16. The system of claim 14, further comprising a container labeling system, the container labeling system comprising a label source configured to have one or more container labels, a label backing removal component, and a label applicator, wherein the label backing removal component comprises a label receiving member and a backing engagement member that is shiftable relative to the label receiving member, and wherein the label applicator comprises a label engagement member in fluid communication with a negative pressure generation source.

17. The system of claim 14, wherein the packing sheet source comprises a roll that includes at least a portion of the reusable packing sheet and extends underneath one or more of a wrapping station, a sizing station, and an alignment station.

18. The system of claim 14, further comprising a wrapping station that that is capable of covering the complementary articles of footwear in a packing material.

19. The system of claim 14, further comprising a transfer station that is capable of transferring the complementary articles of footwear into a container.

20. The system of claim 19, further comprising a container conveyance system, wherein the container conveyance system raises and lowers a container to receive the complementary articles of footwear from the transfer station.

* * * * *